US008935161B2

(12) United States Patent
Oshikiri et al.

(10) Patent No.: US 8,935,161 B2
(45) **Date of Patent: *Jan. 13, 2015**

(54) ENCODING DEVICE, DECODING DEVICE, AND METHOD THEREOF FOR SECIFYING A BAND OF A GREAT ERROR

(71) Applicant: Panasonic Corporation, Osaka (JP)

(72) Inventors: Masahiro Oshikiri, Kanagawa (JP); Tomofumi Yamanashi, Kanagawa (JP); Toshiyuki Morii, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/966,819

(22) Filed: Aug. 14, 2013

(65) Prior Publication Data

US 2014/0019144 A1 Jan. 16, 2014

Related U.S. Application Data

(63) Continuation of application No. 12/528,869, filed as application No. PCT/JP2008/000396 on Feb. 29, 2008, now Pat. No. 8,543,392.

(30) Foreign Application Priority Data

| | | |
|---|---|---|
| Mar. 2, 2007 | (JP) | 2007-053498 |
| May 18, 2007 | (JP) | 2007-133525 |
| Jul. 13, 2007 | (JP) | 2007-184546 |
| Feb. 26, 2008 | (JP) | 2008-044774 |

(51) Int. Cl.

| | |
|---|---|
| ***G10L 19/00*** | (2013.01) |
| ***G10L 19/02*** | (2013.01) |
| ***G10L 19/24*** | (2013.01) |

(52) U.S. Cl.

CPC ..... *G10L 19/00* (2013.01); *G10L 19/0208* (2013.01); *G10L 19/24* (2013.01); *G10L 19/0212* (2013.01)

USPC ..... 704/230; 704/219; 704/500; 704/225; 704/229; 370/401; 370/468; 375/240.11; 700/94

(58) Field of Classification Search

CPC ..... G10L 19/0208; G10L 19/00; G10L 19/24; G10L 19/0212

USPC ..... 704/205, 230, 500–504, 203, 207, 225, 704/229, 219, 226–228; 370/401, 468; 375/240.11; 700/94

See application file for complete search history.

(56) References Cited

U.S. PATENT DOCUMENTS

| | | | |
|---|---|---|---|
| 5,473,727 | A | 12/1995 | Nishiguchi et al. |
| 5,864,802 | A | 1/1999 | Kim et al. |

(Continued)

FOREIGN PATENT DOCUMENTS

| | | |
|---|---|---|
| EP | 1808684 | 7/2007 |
| JP | 2002-100994 | 4/2002 |

(Continued)

OTHER PUBLICATIONS

Balazs Kovesi et al., "A Scalable Speech and Audio Coding Scheme With Continuous Bitrate Flexibility", 2004 IEEE International Conference on Acoustics, Speech and Signal Processing (ICASSP 2004), May 17, 2004, pp. 1273-1276.

(Continued)

*Primary Examiner* — Vijay B Chawan

(74) *Attorney, Agent, or Firm* — Greenblum & Bernstein, P.L.C.

(57) ABSTRACT

Disclosed is an encoding device which can accurately specify a band having a large error among all the bands by using a small calculation amount. A first position identifier uses a first layer error conversion coefficient indicating an error of a decoding signal for an input signal so as to search for a band having a large error in a relatively wide bandwidth in all the bands of the input signal and generates first position information indicating the identified band. A second position identifier searches for a target frequency band having a large error in a relatively narrow bandwidth in the band identified by the first position identifier and generates second position information indicating the identified target frequency band. An encoder encodes a first layer decoding error conversion coefficient contained in the target frequency band.

8 Claims, 41 Drawing Sheets

(56) References Cited

U.S. PATENT DOCUMENTS

| | | | | |
|---|---|---|---|---|
| 5,999,905 | A | 12/1999 | Isozaki | |
| 6,295,009 | B1 | 9/2001 | Goto | |
| 6,529,604 | B1 | 3/2003 | Park et al. | |
| 6,640,145 | B2 * | 10/2003 | Hoffberg et al. | 700/83 |
| 6,950,794 | B1 | 9/2005 | Subramaniam et al. | |
| 7,006,881 | B1 * | 2/2006 | Hoffberg et al. | 700/83 |
| 7,236,839 | B2 | 6/2007 | Fujita et al. | |
| 7,277,849 | B2 | 10/2007 | Streich et al. | |
| 7,343,287 | B2 | 3/2008 | Geiger et al. | |
| 7,457,742 | B2 | 11/2008 | Kovesi et al. | |
| 7,548,852 | B2 | 6/2009 | Den Brinker et al. | |
| 7,720,676 | B2 | 5/2010 | Philippe et al. | |
| 7,724,818 | B2 | 5/2010 | Hannuksela et al. | |
| 8,543,392 | B2 * | 9/2013 | Oshikiri et al. | 704/230 |
| 8,554,549 | B2 * | 10/2013 | Oshikiri et al. | 704/223 |
| 2003/0206558 | A1 | 11/2003 | Parkkinen | |
| 2006/0251178 | A1 | 11/2006 | Oshikiri | |
| 2006/0280271 | A1 | 12/2006 | Oshikiri | |
| 2007/0071116 | A1 | 3/2007 | Oshikiri | |
| 2007/0271102 | A1 | 11/2007 | Morii | |
| 2008/0126082 | A1 | 5/2008 | Ehara et al. | |
| 2009/0055172 | A1 | 2/2009 | Yoshida | |
| 2009/0070107 | A1 | 3/2009 | Kawashima et al. | |
| 2009/0076809 | A1 | 3/2009 | Yoshida | |
| 2009/0083041 | A1 | 3/2009 | Yoshida | |
| 2009/0119111 | A1 | 5/2009 | Goto et al. | |

FOREIGN PATENT DOCUMENTS

| | | |
|---|---|---|
| JP | 2005-107255 | 4/2005 |
| JP | 2006-072026 | 3/2006 |
| JP | 2006-513457 | 4/2006 |
| WO | 2005/027095 | 3/2005 |
| WO | 2005/040749 | 5/2005 |
| WO | 2006/049205 | 5/2006 |

OTHER PUBLICATIONS

Miki, "All about MPEG-4," the first edition, Kogyo Chosakai Publishing, Inc., Sep. 30, 1998, pp. 126-127, with partial English translation.

Jin et al., "Scalable Audio Coding Based on Hierarchical Transform Coding Modules," Academic Journal of The Institute of Electronics, Information and Communication Engineers, vol. J83-A, No. 3, p. 241-252, Mar. 2000.

"AMR Wideband Speech Codec; Transcoding functions," 3GPP TS 26.190, Mar. 2001.

"Source-Controlled-Variable-Rate Multimode Wideband Speech Codec (VMR-WB), Service options 62 and 63 for Spread Spectrum Systems," 3GPP2 C.S0052-A, Apr. 2005.

"7/10/15 kHz band scalable speech coding schemes using the band enhancement technique by means of pitch filtering," Journal of Acoustic Society of Japan Mar. 11, 2004, p. 327-328, Mar. 2004.

U.S. Appl. No. 12/529,212 to Oshikiri, filed Aug. 31, 2009.

U.S. Appl. No. 12/528,661 to Sato et al, filed Aug. 26, 2009.

U.S. Appl. No. 12/528,671 to Kawashima et al, filed Aug. 26, 2009.

U.S. Appl. No. 12/528,659 to Oshikiri et al, filed Aug. 26, 2009.

U.S. Appl. No. 12/528,877 to Morii et al, filed Aug. 27, 2009.

U.S. Appl. No. 12/529,219 to Morii et al, filed Aug. 31, 2009.

U.S. Appl. No. 12/528,871 to Morii et al, filed Aug. 27, 2009.

U.S. Appl. No. 12/528,878 to Ehara, filed Aug. 27, 2009.

U.S. Appl. No. 12/528,880 to Ehara, filed Aug. 27, 2009.

Oshikiri et al., "A scalable coder designed for 10-kHz bandwidth speech", 2002 IEEE Speech Coding Workshop. Proceedings, pp. 111-113, 2002.

Oshikiri et al., "A 10 kHz bandwidth scalable codec using adaptive selection VQ of time-frequency coefficients", Forum on Information Technology, vol. F017, No. pp. 239-240, vol. 2, along with a partial English language Translation, Aug. 25, 2003.

Oshikiri et al., "Efficient Spectrum Coding for Super-Wideband Speech and Its Application to 7/10/15kHz Bandwidth Scalable Coders", Proc. IEEE Int. Conf. Acoustic Speech Signal Process, vol. 2004, No. vol. 1, pp. I-481-I.484, 2004.

Oshikiri et al., "A 7/10/15kHz bandwidth scalable coder using pitch filtering based spectrum coding", The Acoustical Society of Japan, Research Committee Meeting, lecture thesis collection, vol. 2004, pp. 327-328, Spring 1, along with a partial English language Translation, Mar. 17, 2004.

Oshikiri et al., "Improvement of the super-wideband scalable coder using pitch filtering based spectrum coding", The Acoustical Society of Japan, Research Committee Meeting, lecture thesis collection, , vol. 2004, pp. 297-298, Autumn 1, along with a partial English language Translation, Sep. 21, 2004.

Oshikiri et al., "Study on a low-delay MDCT analysis window for a scalable speech coder", The Acoustical Society of Japan, Research Committee Meeting, lecture thesis collection, vol. 2005, pp. 203-204, Spring 1, along with a partial English language Translation, Mar. 8, 2005.

Oshikiri et al., "A 7/10/15 kHz Bandwidth Scalable Speeds Coder Using Pitch Filtering Based Spectrum Coding", IEICE D, vol. J89-D, No. 2, pp. 281-291, along with a partial English language Translation, Feb. 1, 2006.

Koishida et al., "A 16-kbit/s bandwidth scalable audio coder based on the G.729 standard", Proc. IEEE ICASSP 2000, pp. II-1149-II-1152, Jun. 2000.

Dietz et al., "Spectral band replication, a novel approach in audio coding", The 112th Audio Engineering Society Convention, Paper 5553, May 2002.

Oshikiri, "Research on variable bit rate high efficiency speech coding focused on speech spectrum", Doctoral thesis, Tokai University, along with a partial English language Translation, Mar. 24, 2006.

Jin et al., "Scalable Audio Coding Based on Hierarchical Transform Coding Modules", IEICE, vol. J83-A, No. 3, pp. 241-252, along with a partial English language Translation, Mar. 2000.

B. Grill, "A bit rate scalable perceptual coder for MPEG-4 audio", The 103rd Audio Engineering Society Convention, Preprint 4620 , Sep. 1997.

S. Ramprashad, "A two stage hybrid embedded speech/audio coding structure", Proc. IEEE ICASSP '98, pp. 337-340, May 1998.

Kovesi et al., "A scalable speech and audio coding scheme with continuous bitrate flexibility", Proc. IEEE ICASSP 2004, pp. I-273-I-276, May 2004.

Jung et al., "A bit-rate/bandwidth scalable speech coder based on ITU-T G.723.1 standard", Proc. IEEE ICASSP 2004, pp. I-285-I-288, May 2004.

Oshikiri et al., "A narrowband/wideband scalable speech coder using AMR coder as a core-layer", The Acoustical Society of Japan, Research Committee Meeting, lecture thesis collection(CD-ROM), vol. 2006, pp. 389-390, Q-28 Spring, along with a partial English language Translation, Mar. 7, 2006.

Oshikiri et al., "An 8-32 kbit/s scalable wideband coder extended with MDCT-based bandwidth extension on top of a 6.8 kbit/s narrowband CELP code", International Speech Communication Association, 8th Annual Conference of the International Speech Communication Association, Interspeech 2007., vol. 1, pp. 465-468, Aug. 27, 2007.

Kim et al., "A new bandwidth scalable wideband speech/audio coder", Proceedings of IEEE International Conference on Acoustics, Speech and Signal Processing 2002 (ICASSP-2002), pp. I-657-I-660, 2002.

Geiser et al., "A qualified ITU-T G.729EV codec candidate for hierachical speech and audio coding", Proceedings of IEEE 8th Workshop on Multimedia Signal Processing, pp. 114-118, Oct. 3, 2006.

Ragot et al., "A 8-32 kbit/s scalable wideband speech and audio coding candidate for ITU-T G729EV standardization", Proceedings of IEEE International Conference on Acoustics Speech and Signal Processing 2006 (ICASSP-2006), pp. I-1-I-4, May 14, 2006.

Massaloux et al., "An 8-12 kbit/s embedded CELP coder interoperable with ITU-T G.729 coder: first stage of the new G.729.1 standard", Proceedings of IEEE International Conference on Acoustics, Speech and Signal Processing 2007 (ICASSP-2007), pp. IV-1105-IV-1108, Apr. 15, 2007.

* cited by examiner

ENCODING DEVICE, DECODING DEVICE, AND METHOD THEREOF FOR SECIFYING A BAND OF A GREAT ERROR

CROSS-REFERENCE TO RELATED APPLICATION

This is a continuation application of pending U.S. application Ser. No. 12/528,869, having a §371(c) date of Aug. 27, 2009, which is a national stage entry of International Application No. PCT/JP2008/000396, filed Feb. 29, 2008, and which claims priority to Japanese Application Nos. 2007-053498, filed Mar. 2, 2007, 2007-133525, filed May 18, 2007, 2007-184546, filed Jul. 13, 2007, and 2008-044774, filed Feb. 26, 2008. The disclosures of these documents, including the specifications, drawings, and claims, are incorporated herein by reference in their entireties.

TECHNICAL FIELD

The present invention relates to an encoding apparatus, decoding apparatus and methods thereof used in a communication system of a scalable coding scheme.

BACKGROUND ART

It is demanded in a mobile communication system that speech signals are compressed to low bit rates to transmit to efficiently utilize radio wave resources and so on. On the other hand, it is also demanded that quality improvement in phone call speech and call service of high fidelity be realized, and, to meet these demands, it is preferable to not only provide quality speech signals but also encode other quality signals than the speech signals, such as quality audio signals of wider bands.

The technique of integrating a plurality of coding techniques in layers is promising for these two contradictory demands. This technique combines in layers the first layer for encoding input signals in a form adequate for speech signals at low bit rates and a second layer for encoding differential signals between input signals and decoded signals of the first layer in a form adequate to other signals than speech. The technique of performing layered coding in this way have characteristics of providing scalability in bit streams acquired from an encoding apparatus, that is, acquiring decoded signals from part of information of bit streams, and, therefore, is generally referred to as "scalable coding (layered coding)."

The scalable coding scheme can flexibly support communication between networks of varying bit rates thanks to its characteristics, and, consequently, is adequate for a future network environment where various networks will be integrated by the IP protocol.

For example, Non-Patent Document 1 discloses a technique of realizing scalable coding using the technique that is standardized by MPEG-4 (Moving Picture Experts Group phase-4).

This technique uses CELP (Code Excited Linear Prediction) coding adequate to speech signals, in the first layer, and uses transform coding such as AAC (Advanced Audio Coder) and TwinVQ (Transform Domain Weighted Interleave Vector Quantization) with respect to residual signals subtracting first layer decoded signals from original signals, in the second layer.

By contrast with this, Non-Patent Document 2 discloses a method of encoding MDCT coefficients of a desired frequency bands in layers using TwinVQ that is applied to a module as a basic component. By sharing this module to use a plurality of times, it is possible to implement simple scalable coding of a high degree of flexibility. Although this method is based on the configuration where subbands which are the targets to be encoded by each layer are determined in advance, a configuration is also disclosed where the position of a subband, which is the target to be encoded by each layer, is changed within predetermined bands according to the property of input signals.

Non-Patent Document 1: "All about MPEG-4," written and edited by Sukeichi MIKI, the first edition, Kogyo Chosakai Publishing, Inc., Sep. 30, 1998, page 126 to 127

Non-Patent Document 2: "Scalable Audio Coding Based on Hierarchical Transform Coding Modules," Akio JIN et al., Academic Journal of The Institute of Electronics, Information and Communication Engineers, Volume J83-A, No. 3, page 241 to 252, March, 2000

Non-Patent Document 3: "AMR Wideband Speech Codec; Transcoding functions," 3GPP TS 26.190, March 2001.

Non-Patent Document 4: "Source-Controlled-Variable-Rate Multimode Wideband Speech Codec (VMR-WB), Service options 62 and 63 for Spread Spectrum Systems," 3GPP2 C.S0052-A, April 2005.

Non-Patent Document 5: "7/10/15 kHz band scalable speech coding schemes using the band enhancement technique by means of pitch filtering," Journal of Acoustic Society of Japan 3-11-4, page 327 to 328, March 2004

DISCLOSURE OF THE INVENTION

Problems to be Solved by the Invention

However, to improve the speech quality of output signals, how subbands (i.e. target frequency bands) of the second layer encoding section are set, is important. The method disclosed in Non-Patent Document 2 determines in advance subbands which are the target to be encoded by the second layer (FIG. 1A). In this case, quality of predetermined subbands is improved at all times and, therefore, there is a problem that, when error components are concentrated in other bands than these subbands, it is not possible to acquire an improvement effect of speech quality very much.

Further, although Non-Patent Document 2 discloses that the position of a subband, which is the target to be encoded by each layer, is changed within predetermined bands (FIG. 1B) according to the property of input signals, the position employed by the subband is limited within the predetermined bands and, therefore, the above-described problem cannot be solved. If a band employed as a subband covers a full band of an input signal (FIG. 1C), there is a problem that the computational complexity to specify the position of a subband increases. Furthermore, when the number of layers increases, the position of a subband needs to be specified on a per layer basis and, therefore, this problem becomes substantial.

It is therefore an object of the present invention to provide an encoding apparatus, decoding apparatus and methods thereof for, in a scalable coding scheme, accurately specifying a band of a great error from the full band with a small computational complexity.

Means for Solving the Problem

The encoding apparatus according to the present invention employs a configuration which includes: a first layer encoding section that performs encoding processing with respect to input transform coefficients to generate first layer encoded data; a first layer decoding section that performs decoding processing using the first layer encoded data to generate first layer decoded transform coefficients; and a second layer encoding section that performs encoding processing with respect to a target frequency band where, in first layer error transform coefficients representing an error between the input transform coefficients and the first layer decoded transform coefficients, a maximum error is found, to generate second layer encoded data, and in which wherein the second layer encoding section has: a first position specifying section that searches for a first band having the maximum error throughout a full band, based on a wider bandwidth than the target frequency band and a predetermined first step size to generate first position information showing the specified first band; a second position specifying section that searches for the target frequency band throughout the first band, based on a narrower second step size than the first step size to generate second position information showing the specified target frequency band; and an encoding section that encodes the first layer error transform coefficients included in the target frequency band specified based on the first position information and the second position information to generate encoded information.

The decoding apparatus according to the present invention employs a configuration which includes: a receiving section that receives: first layer encoded data acquired by performing encoding processing with respect to input transform coefficients; second layer encoded data acquired by performing encoding processing with respect to a target frequency band where, in first layer error transform coefficients representing an error between the input transform coefficients and first layer decoded transform coefficients which are acquired by decoding the first layer encoded data, a maximum error is found; first position information showing a first band which maximizes the error, in a bandwidth wider than the target frequency band; and second position information showing the target frequency band in the first band; a first layer decoding section that decodes the first layer encoded data to generate first layer decoded transform coefficients; a second layer decoding section that specifies the target frequency band based on the first position information and the second position information and decodes the second layer encoded data to generate first layer decoded error transform coefficients; and an adding section that adds the first layer decoded transform coefficients and the first layer decoded error transform coefficients to generate second layer decoded transform coefficients.

The encoding method according to the present invention includes: a first layer encoding step of performing encoding processing with respect to input transform coefficients to generate first layer encoded data; a first layer decoding step of performing decoding processing using the first layer encoded data to generate first layer decoded transform coefficients; and a second layer encoding step of performing encoding processing with respect to a target frequency band where, in first layer error transform coefficients representing an error between the input transform coefficients and the first layer decoded transform coefficients, a maximum error is found, to generate second layer encoded data, where the second layer encoding step includes: a first position specifying step of searching for a first band having the maximum error throughout a full band, based on a wider bandwidth than the target frequency band and a predetermined first step size to generate first position information showing the specified first band; a second position specifying step of searching for the target frequency band throughout the first band, based on a narrower second step size than the first step size to generate second position information showing the specified target frequency band; and an encoding step of encoding the first layer error transform coefficients included in the target frequency band specified based on the first position information and the second position information to generate encoded information.

The decoding method according to the present invention includes: a receiving step of receiving: first layer encoded data acquired by performing encoding processing with respect to input transform coefficients; second layer encoded data acquired by performing encoding processing with respect to a target frequency band where, in first layer error transform coefficients representing an error between the input transform coefficients and first layer decoded transform coefficients which are acquired by decoding the first layer encoded data, a maximum error is found; first position information showing a first band which maximizes the error, in a bandwidth wider than the target frequency band; and second position information showing the target frequency band in the first band; a first layer decoding step of decoding the first layer encoded data to generate first layer decoded transform coefficients; a second layer decoding step of specifying the target frequency band based on the first position information and the second position information and decoding the second layer encoded data to generate first layer decoded error transform coefficients; and an adding step of adding the first layer decoded transform coefficients and the first layer decoded error transform coefficients to generate second layer decoded transform coefficients.

Advantageous Effects of Invention

According to the present invention, the first position specifying section searches for the band of a great error throughout the full band of an input signal, based on relatively wide bandwidths and relatively rough step sizes to specify the band of a great error, and a second position specifying section searches for the target frequency band (i.e. the frequency band having the greatest error) in the band specified in the first position specifying section based on relatively narrower bandwidths and relatively narrower step sizes to specify the band having the greatest error, so that it is possible to specify the band of a great error from the full band with a small computational complexity and improve sound quality.

BEST MODE FOR CARRYING OUT THE INVENTION

Embodiments of the present invention will be explained in details below with reference to the accompanying drawings.

Embodiment 1

Figure 1A:
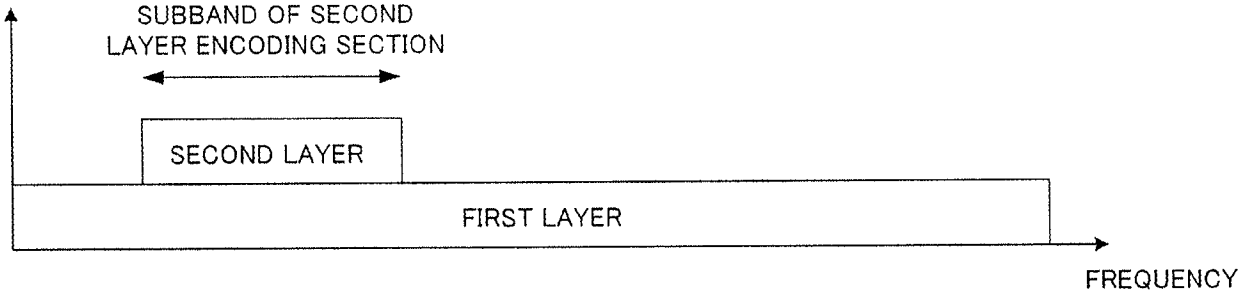
FIGS. 1A-1C show an encoded band of the second layer encoding section of a conventional speech encoding apparatus.
Figure 1B:
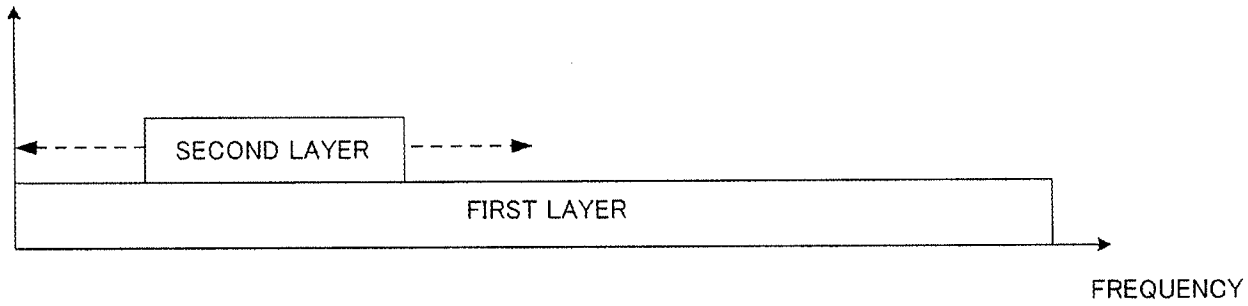
Figure 1C:
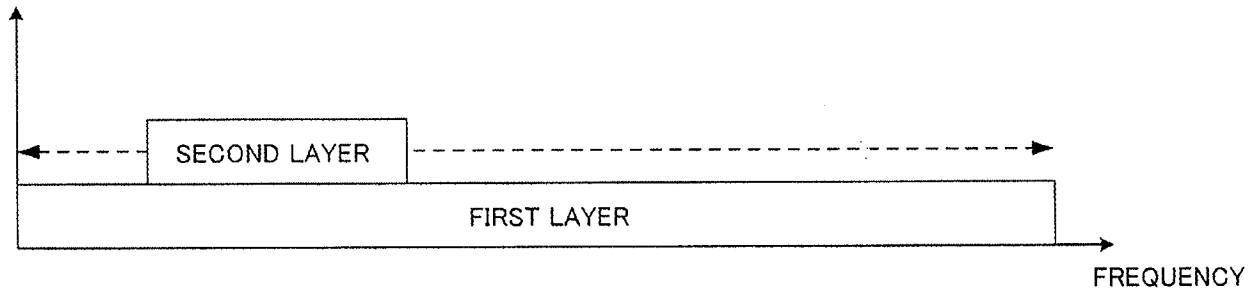
Figure 2:
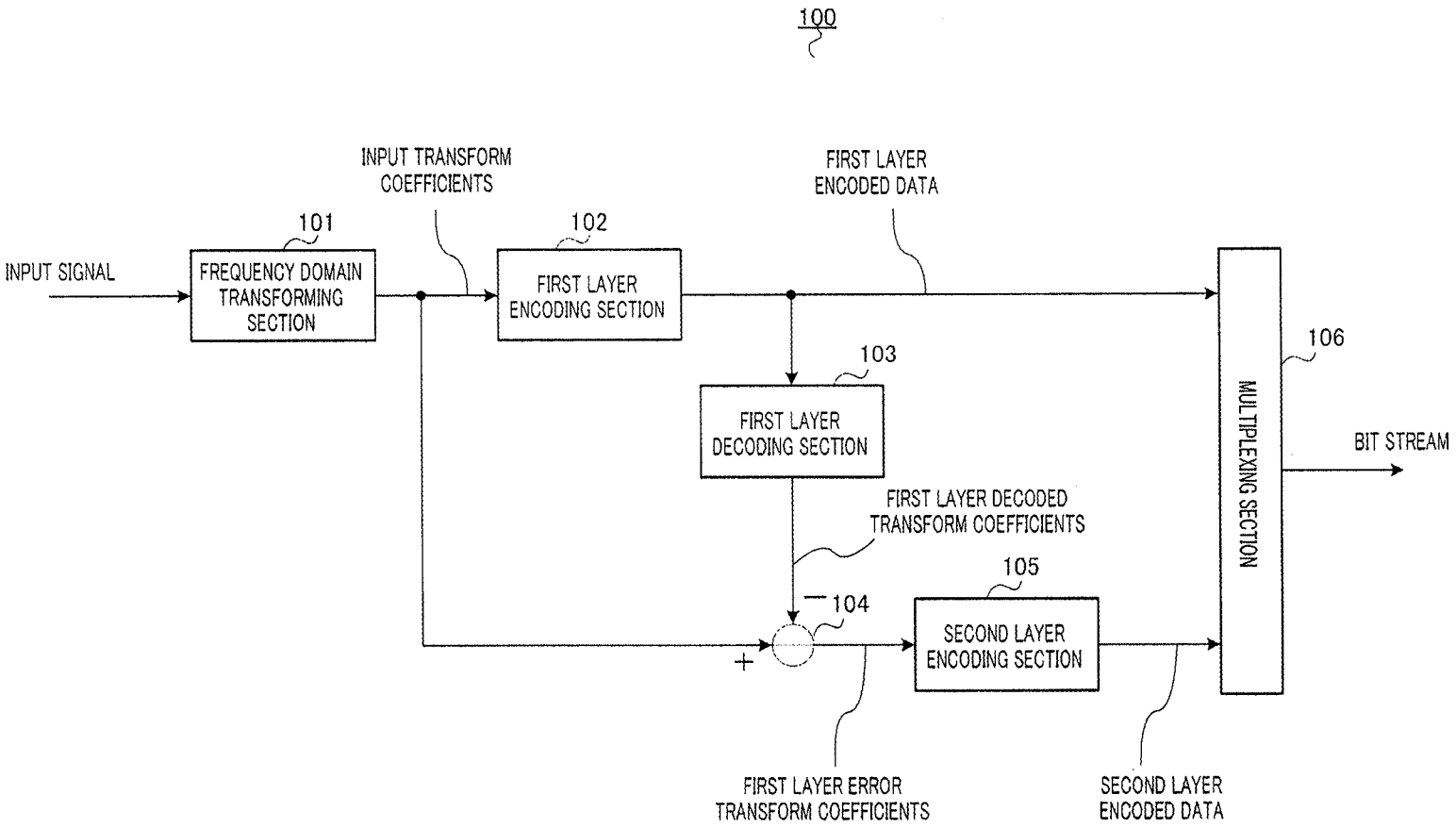
FIG. 2 is a block diagram showing the main configuration of an encoding apparatus according to Embodiment 1 of the present invention.

FIG. 2 is a block diagram showing the main configuration of an encoding apparatus according to Embodiment 1 of the present invention. Encoding apparatus 100 shown in FIG. 2 has frequency domain transforming section 101, first layer encoding section 102, first layer decoding section 103, subtracting section 104, second layer encoding section 105 and multiplexing section 106.

Frequency domain transforming section 101 transforms a time domain input signal into a frequency domain signal (i.e. input transform coefficients), and outputs the input transform coefficients to first layer encoding section 102.

First layer encoding section 102 performs encoding processing with respect to the input transform coefficients to generate first layer encoded data, and outputs this first layer encoded data to first layer decoding section 103 and multiplexing section 106.

First layer decoding section 103 performs decoding processing using the first layer encoded data to generate first layer decoded transform coefficients, and outputs the first layer decoded transform coefficients to subtracting section 104.

Subtracting section 104 subtracts the first layer decoded transform coefficients generated in first layer decoding section 103, from the input transform coefficients, to generate first layer error transform coefficients, and outputs this first layer error transform coefficients to second layer encoding section 105.

Second layer encoding section 105 performs encoding processing of the first layer error transform coefficients outputted from subtracting section 104, to generate second layer encoded data, and outputs this second layer encoded data to multiplexing section 106.

Multiplexing section 106 multiplexes the first layer encoded data acquired in first layer encoding section 102 and the second layer encoded data acquired in second layer encoding section 105 to form a bit stream, and outputs this bit stream as final encoded data, to the transmission channel.

Figure 3:
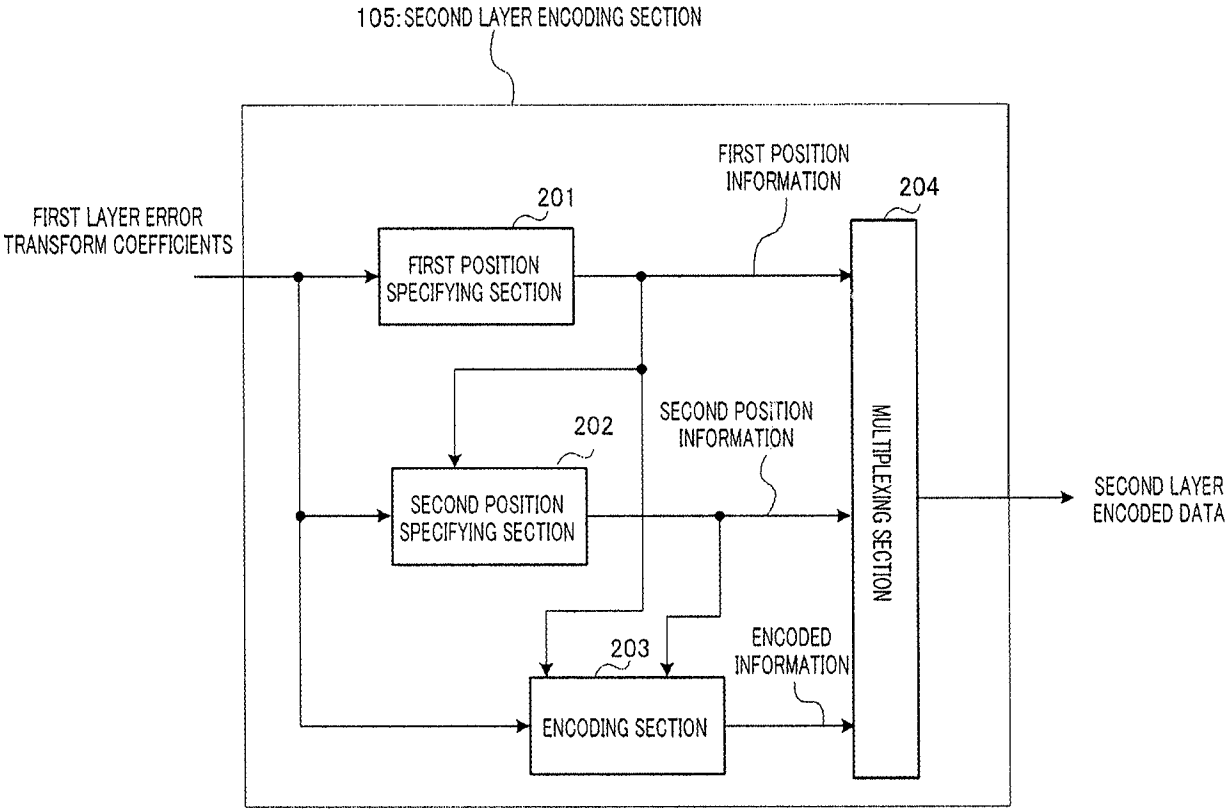
FIG. 3 is a block diagram showing the configuration of the second layer encoding section shown in FIG. 2.

FIG. 3 is a block diagram showing a configuration of second layer encoding section 105 shown in FIG. 2. Second layer encoding section 105 shown in FIG. 3 has first position specifying section 201, second position specifying section 202, encoding section 203 and multiplexing section 204.

First position specifying section 201 uses the first layer error transform coefficients received from subtracting section 104 to search for a band employed as the target frequency band, which are target to be encoded, based on predetermined bandwidths and predetermined step sizes, and outputs information showing the specified band as first position information, to second position specifying section 202, encoding section 203 and multiplexing section 204. Meanwhile, first position specifying section 201 will be described later in details. Further, these specified band may be referred to as "range" or "region."

Second position specifying section 202 searches for the target frequency band in the band specified in first position specifying section 201 based on narrower bandwidths than the bandwidths used in first position specifying section 201 and narrower step sizes than the step sizes used in first position specifying section 201, and outputs information showing the specified target frequency band as second position information, to encoding section 203 and multiplexing section 204. Meanwhile, second position specifying section 202 will be described later in details.

Encoding section 203 encodes the first layer error transform coefficients included in the target frequency band specified based on the first position information and second position information to generate encoded information, and outputs the encoded information to multiplexing section 204. Meanwhile, encoding section 203 will be described later in details.

Multiplexing section 204 multiplexes the first position information, second position information and encoded information to generate second encoded data, and outputs this second encode data. Further, this multiplexing section 204 is not indispensable and these items of information may be outputted directly to multiplexing section 106 shown in FIG. 2.

Figure 4:
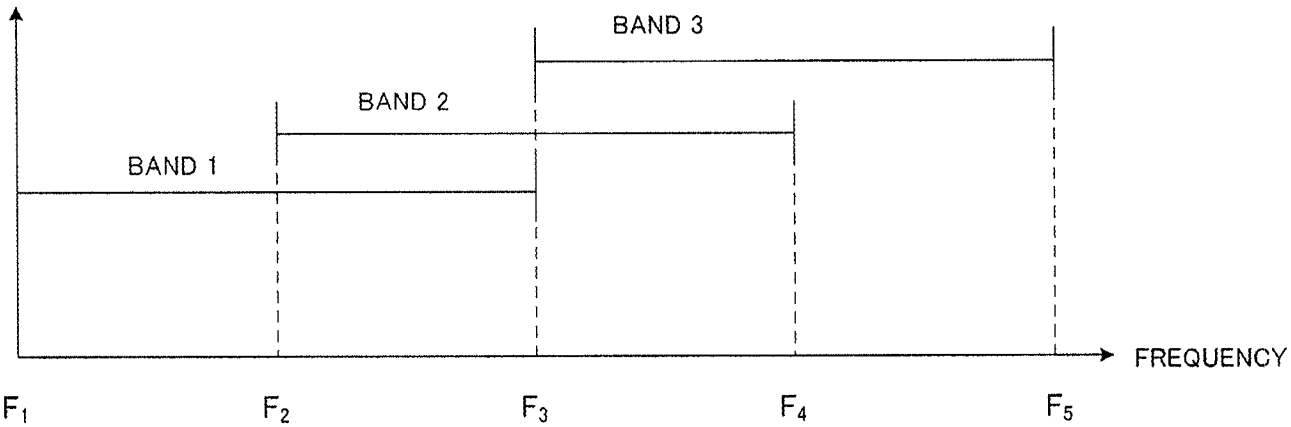
FIG. 4 shows the position of a band specified in the first position specifying section shown in FIG. 3.

FIG. 4 shows the band specified in first position specifying section 201 shown in FIG. 3.

In FIG. 4, first position specifying section 201 specifies one of three bands set based on a predetermined bandwidth, and outputs position information of this band as first position information, to second position specifying section 202, encoding section 203 and multiplexing section 204. Each band shown in FIG. 4 is configured to have a bandwidth equal to or wider than the target frequency bandwidth (band 1 is equal to or higher than $F_1$ and lower than $F_3$, band 2 is equal to or higher than $F_2$ and lower than $F_4$, and band 3 is equal to or higher than $F_3$ and lower than $F_5$). Further, although each band is configured to have the same bandwidth with the present embodiment, each band may be configured to have a different bandwidth. For example, like the critical bandwidth of human perception, the bandwidths of bands positioned in a low frequency band may be set narrow and the bandwidths of bands positioned in a high frequency band may be set wide.

Next, the method of specifying a band in first position specifying section 201 will be explained. Here, first position specifying section 201 specifies a band based on the magnitude of energy of the first layer error transform coefficients. The first layer error transform coefficients are represented as $e_1(k)$, and energy $E_R(i)$ of the first layer error transform coefficients included in each band is calculated according to following equation 1.

(Equation 1)

$$E_R(i) = \sum_{k=FRL(i)}^{FRH(i)-1} e_1(k)^2 \quad [1]$$

Here, i is an identifier that specifies a band, FRL(i) is the lowest frequency of the band i and FRH(i) is the highest frequency of the band i.

In this way, the band of greater energy of the first layer error transform coefficients are specified and the first layer error transform coefficients included in the band of a great error are encoded, so that it is possible to decrease errors between decoded signals and input signals and improve speech quality.

Meanwhile, normalized energy $NE_R(i)$, normalized based on the bandwidth as in following equation 2, may be calculated instead of the energy of the first layer error transform coefficients.

(Equation 2)

$$NE_R(i) = \frac{1}{FRH(i) - FRL(i)} \sum_{k=FRL(i)}^{FRH(i)-1} e_1(k)^2 \quad [2]$$

Further, as the reference to specify the band, instead of energy of the first layer error transform coefficients, the energy $WE_R(i)$ and $WNE_R(i)$ of the first layer error transform coefficients (normalized energy that is normalized based on the bandwidth), to which weight is applied taking into account the characteristics of human perception, may be found according to equations 3 and 4. Here, w(k) represents weight related to the characteristics of human perception.

(Equation 3)

$$WE_R(i) = \sum_{k=FRL(i)}^{FRH(i)-1} w(k) \cdot e_1(k)^2 \quad [3]$$

(Equation 4)

$$WNE_R(i) = \frac{1}{FRH(i) - FRL(i)} \sum_{k=FRL(i)}^{FRH(i)-1} w(k) \cdot e_1(k)^2 \quad [4]$$

In this case, first position specifying section 201 increases weight for the frequency of high importance in the perceptual characteristics such that the band including this frequency is likely to be selected, and decreases weight for the frequency of low importance such that the band including this frequency is not likely to be selected. By this means, a perceptually important band is preferentially selected, so that it is possible to provide a similar advantage of improving sound quality as described above. Weight may be calculated and used utilizing, for example, human perceptual loudness characteristics or perceptual masking threshold calculated based on an input signal or first layer decoded signal.

Figure 5:
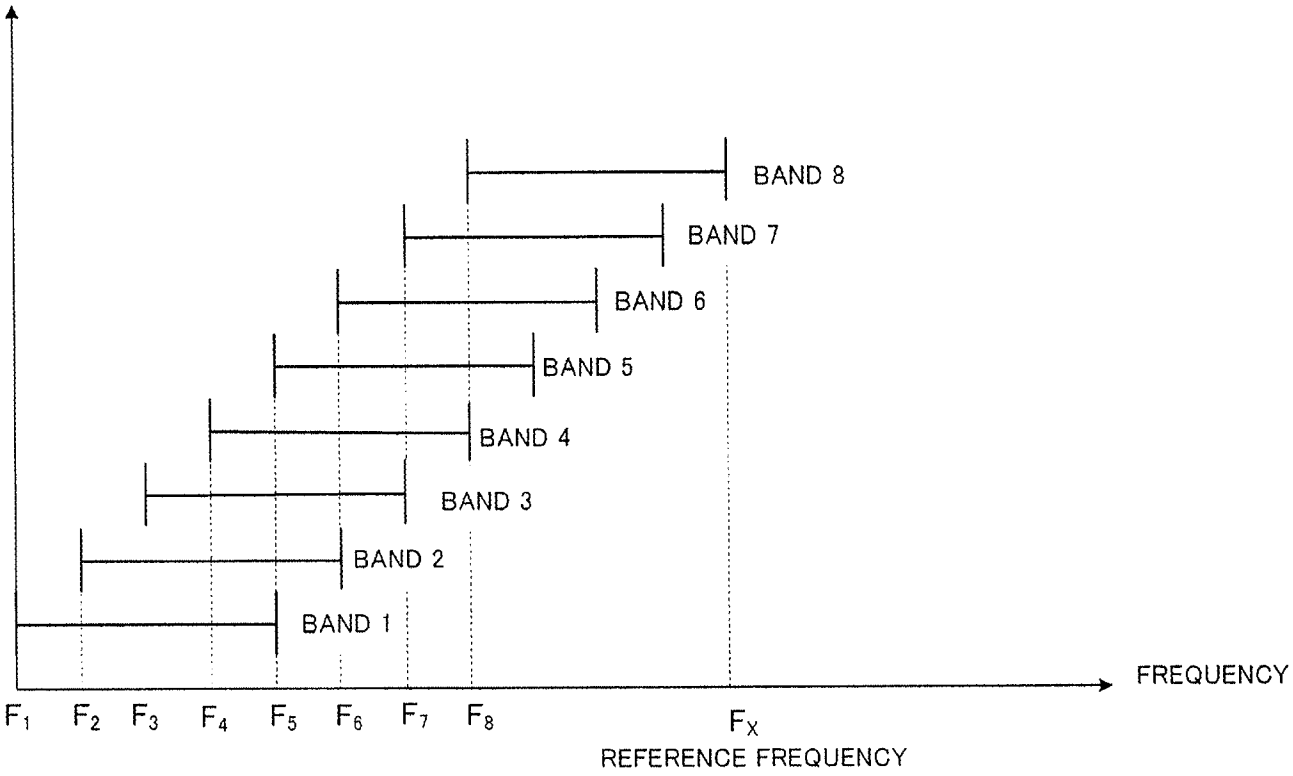
FIG. 5 shows another position of a band specified in the first position specifying section shown in FIG. 3.

Further, the band selecting method may select a band from bands arranged in a low frequency band having a lower frequency than the reference frequency (Fx) which is set in advance. With the example of FIG. 5, band is selected in band 1 to band 8. The reason to set limitation (i.e. reference frequency) upon selection of bands is as follows. With a harmonic structure or harmonics structure which is one characteristic of a speech signal (i.e. a structure in which peaks appear in a spectrum at given frequency intervals), greater peaks appear in a low frequency band than in a high frequency band and peaks appear more sharply in a low frequency band than in a high frequency band similar to a quantization error (i.e. error spectrum or error transform coefficients) produced in encoding processing. Therefore, even when the energy of an error spectrum (i.e. error transform coefficients) in a low frequency band is lower than in a high frequency band, peaks in an error spectrum (i.e. error transform coefficients) in a low frequency band appear more sharply than in a high frequency band, and, therefore, an error spectrum (i.e. error transform coefficients) in the low frequency band is likely to exceed a perceptual masking threshold (i.e. threshold at which people can perceive sound) causing deterioration in perceptual sound quality.

This method sets the reference frequency in advance to determine the target frequency from a low frequency band in which peaks of error coefficients (or error vectors) appear more sharply than in a high frequency band having a higher frequency than the reference frequency (Fx), so that it is possible to suppress peaks of the error transform coefficients and improve sound quality.

Further, with the band selecting method, the band may be selected from bands arranged in low and middle frequency band. With the example in FIG. 4, band 3 is excluded from the selection candidates and the band is selected from band 1 and band 2. By this means, the target frequency band is determined from low and middle frequency band.

Hereinafter, as first position information, first position specifying section 201 outputs "1" when band 1 is specified, "2" when band 2 is specified and "3" when band 3 is specified.

Figure 6:
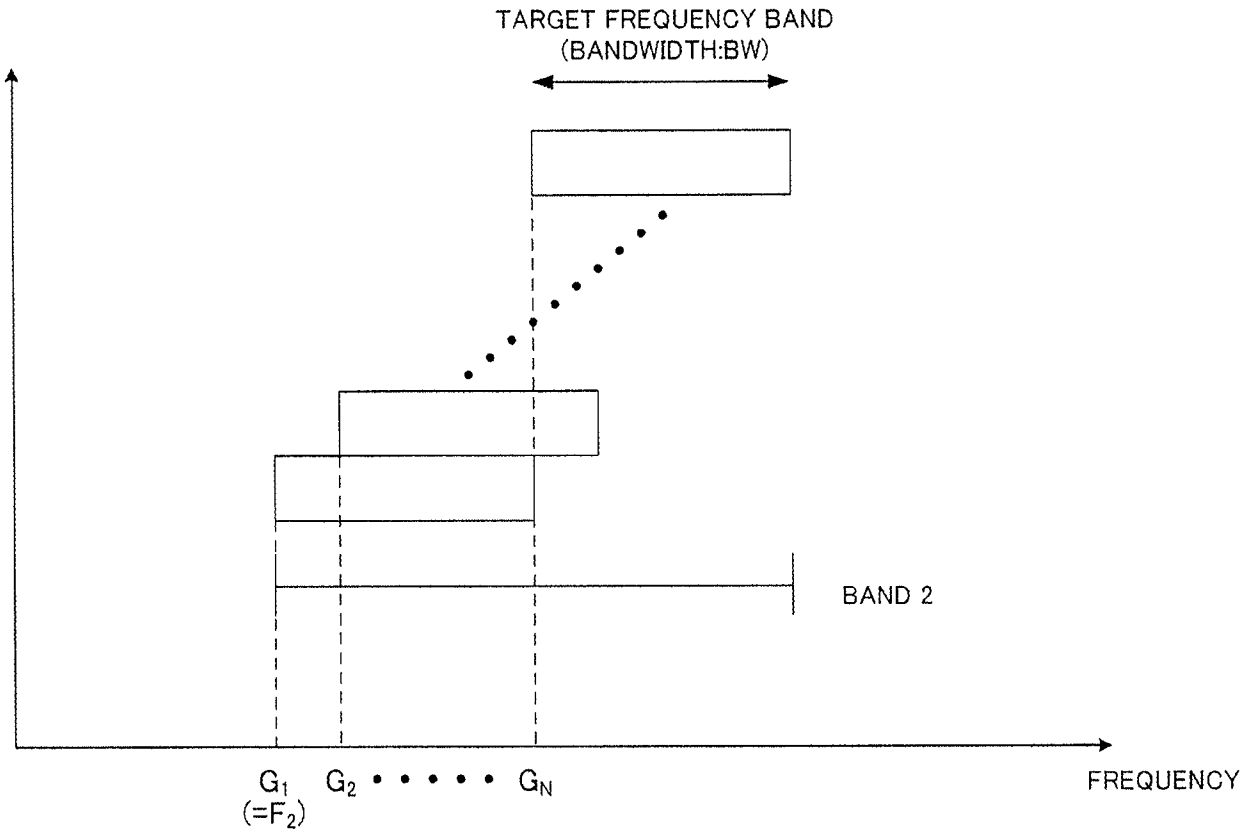
FIG. 6 shows the position of target frequency band specified in the second position specifying section shown in FIG. 3.

FIG. 6 shows the position of the target frequency band specified in second position specifying section 202 shown in FIG. 3.

Second position specifying section 202 specifies the target frequency band in the band specified in first position specifying section 201 based on narrower step sizes, and outputs position information of the target frequency band as second position information, to encoding section 203 and multiplexing section 204.

Next, the method of specifying the target frequency band in second position specifying section 202 will be explained.

Here, referring to an example where first position information outputted from first position specifying section 201 shown in FIG. 3 is "2," the width of the target frequency band is represented as "BW." Further, the lowest frequency $F_2$ in band 2 is set as the base point, and this lowest frequency $F_2$ is represented as $G_1$ for ease of explanation. Then, the lowest frequencies of the target frequency band that can be specified in second position specifying section 202 is set to $G_2$ to $G_N$. Further, the step sizes of target frequency bands that are specified in second position specifying section 202 are $G_n$-$G_{n-1}$ and step sizes of the bands that are specified in first position specifying section 201 are $F_n$-$F_{n-1}$($G_n$-$G_{n-1}$< $F_n$-$F_{n-1}$).

Second position specifying section 202 specifies the target frequency band from target frequency candidates having the lowest frequencies $G_1$ to $G_N$, based on energy of the first layer error transform coefficients or based on a similar reference. For example, second position specifying section 202 calculates the energy of the first layer error transform coefficients according to equation 5 for all of $G_n$ target frequency candidates, specifies the target frequency band where the greatest energy $E_R(n)$ is calculated, and outputs position information of this target frequency as second position information.

(Equation 5)

$$E_R(n) = \sum_{k=G_n}^{G_n+BW-1} e_1(k)^2 \quad (1 \le n \le N) \qquad [5]$$

Further, when the energy of first layer error transform coefficients $WE_R(n)$, to which weight is applied taking the characteristics of human perception into account as explained above, is used as a reference, $WE_R(n)$ is calculated according to following equation 6. Here, w(k) represents weight related to the characteristics of human perception. Weight may be found and used utilizing, for example, human perceptual loudness characteristics or perceptual masking threshold calculated based on an input signal or the first layer decoded signal.

(Equation 6)

$$WE_R(n) = \sum_{k=G_n}^{G_n+BW-1} w(k) \cdot e_1(k)^2 \quad (1 \le n \le N) \qquad [6]$$

In this case, second position specifying section 202 increases weight for the frequency of high importance in perceptual characteristics such that the target frequency band including this frequency is likely to be selected, and decreases weight for the frequency of low importance such that the target frequency band including this frequency is not likely to be selected. By this means, the perceptually important target frequency band is preferentially selected, so that it is possible to further improve sound quality.

Figure 7:
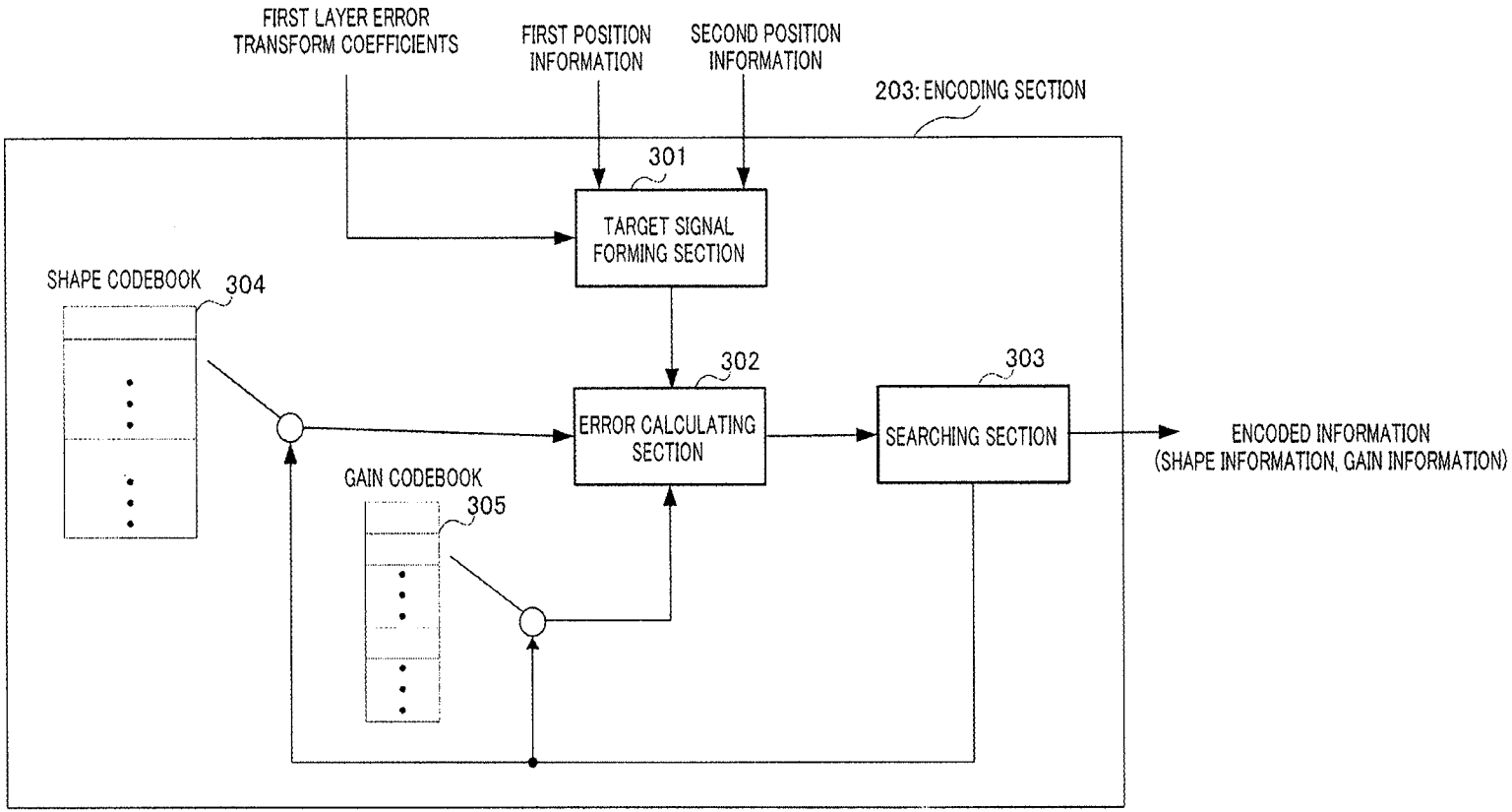
FIG. 7 is a block diagram showing the configuration of an encoding section shown in FIG. 3.

FIG. 7 is a block diagram showing a configuration of encoding section 203 shown in FIG. 3. Encoding section 203 shown in FIG. 7 has target signal forming section 301, error calculating section 302, searching section 303, shape codebook 304 and gain codebook 305.

Target signal forming section 301 uses first position information received from first position specifying section 201 and second position information received from second position specifying section 202 to specify the target frequency band, extracts a portion included in the target frequency band based on the first layer error transform coefficients received from subtracting section 104 and outputs the extracted first layer error transform coefficients as a target signal, to error calculating section 302. This first error transform coefficients are represented as $e_1(k)$.

Error calculating section 302 calculates the error E according to following equation 7 based on: the i-th shape candidate received from shape codebook 304 that stores candidates (shape candidates) which represent the shape of error transform coefficients; the m-th gain candidate received from gain codebook 305 that stores candidates (gain candidates) which represent gain of the error transform coefficients; and a target signal received from target signal forming section 301, and outputs the calculated error E to searching section 303.

(Equation 7)

$$E = \sum_{k=0}^{BW-1} (e_1(k) - ga(m) \cdot sh(i, k))^2 \qquad [7]$$

Here, sh(i,k) represents the i-th shape candidate and ga(m) represents the m-th gain candidate.

Searching section 303 searches for the combination of a shape candidate and gain candidate that minimizes the error E, based on the error E calculated in error calculating section 302, and outputs shape information and gain information of the search result as encoded information, to multiplexing section 204 shown in FIG. 3. Here, the shape information is a parameter m that minimizes the error E and the gain information is a parameter i that minimizes the error E.

Further, error calculating section 302 may calculate the error E according to following equation 8 by applying great weight to a perceptually important spectrum and by increasing the influence of the perceptually important spectrum. Here, w(k) represents weight related to the characteristics of human perception.

(Equation 8)

$$E = \sum_{k=0}^{BW-1} w(k) \cdot (e_1(k) - ga(m) \cdot sh(i, k))^2 \quad [8]$$

In this way, while weight for the frequency of high importance in the perceptual characteristics is increased and the influence of quantization distortion of the frequency of high importance in the perceptual characteristics is increased, weight for the frequency of low importance is decreased and the influence of quantization distortion of the frequency of low importance is decreased, so that it is possible to improve subjective quality.

Figure 8:
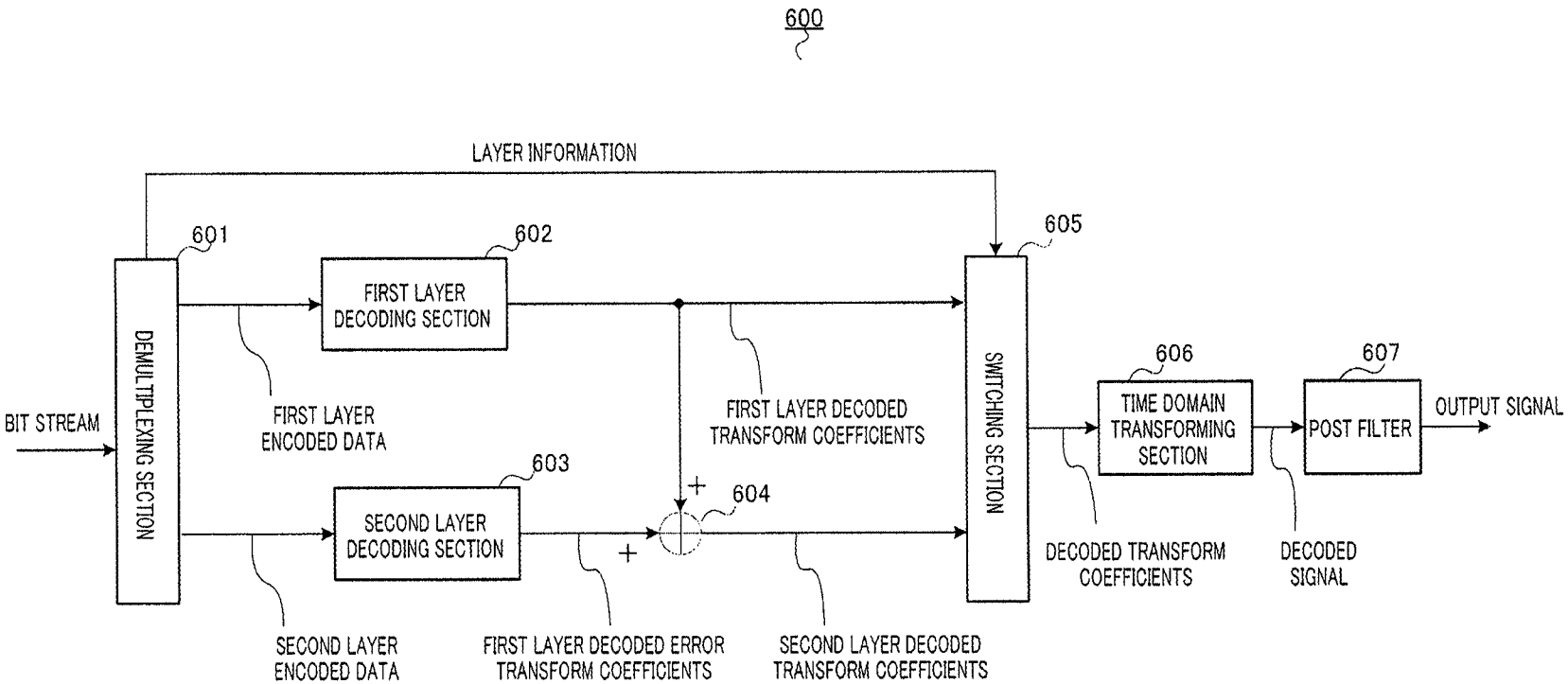
FIG. 8 is a block diagram showing a main configuration of a decoding apparatus according to Embodiment 1 of the present invention.

FIG. 8 is a block diagram showing the main configuration of the decoding apparatus according to the present embodiment. Decoding apparatus 600 shown in FIG. 8 has demultiplexing section 601, first layer decoding section 602, second layer decoding section 603, adding section 604, switching section 605, time domain transforming section 606 and post filter 607.

Demultiplexing section 601 demultiplexer a bit stream received through the transmission channel, into first layer encoded data and second layer encoded data, and outputs the first layer encoded data and second layer encode data to first layer decoding section 602 and second layer decoding section 603, respectively. Further, when the inputted bit stream includes both the first layer encoded data and second layer encoded data, demultiplexing section 601 outputs "2" as layer information to switching section 605. By contrast with this, when the bit stream includes only the first layer encoded data, demultiplexing section 601 outputs "1" as layer information to switching section 605. Further, there are cases where all encoded data is discarded, and, in such cases, the decoding section in each layer performs predetermined error compensation processing and the post filter performs processing assuming that layer information shows "1." The present embodiment will be explained assuming that the decoding apparatus acquires all encoded data or encoded data from which the second layer encoded data is discarded.

First layer decoding section 602 performs decoding processing of the first layer encoded data to generate the first layer decoded transform coefficients, and outputs the first layer decoded transform coefficients to adding section 604 and switching section 605.

Second layer decoding section 603 performs decoding processing of the second layer encoded data to generate the first layer decoded error transform coefficients, and outputs the first layer decoded error transform coefficients to adding section 604.

Adding section 604 adds the first layer decoded transform coefficients and the first layer decoded error transform coefficients to generate second layer decoded transform coefficients, and outputs the second layer decoded transform coefficients to switching section 605.

Based on layer information received from demultiplexing section 601, switching section 605 outputs the first layer decoded transform coefficients when layer information shows "1" and the second layer decoded transform coefficients when layer information shows "2" as decoded transform coefficients, to time domain transforming section 606.

Time domain transforming section 606 transforms the decoded transform coefficients into a time domain signal to generate a decoded signal, and outputs the decoded signal to post filter 607.

Post filter 607 performs post filtering processing with respect to the decoded signal outputted from time domain transforming section 606, to generate an output signal.

Figure 9:
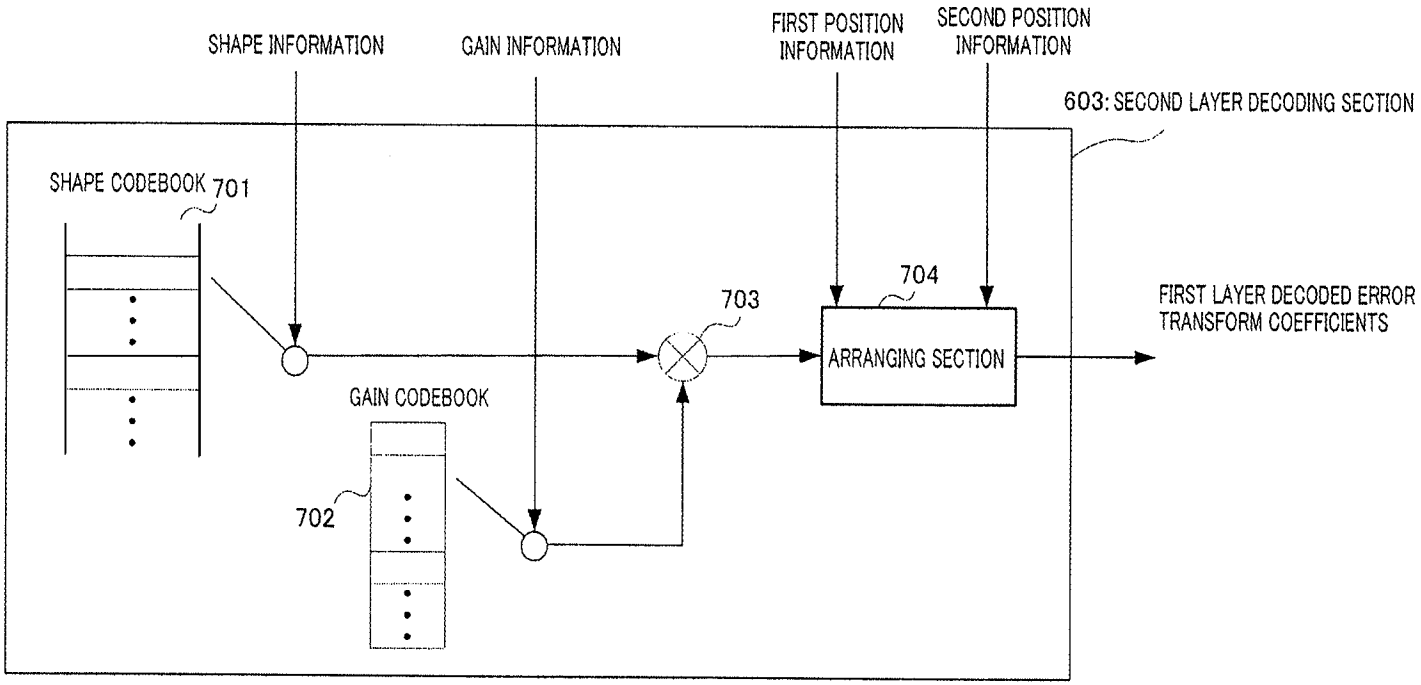
FIG. 9 shows the configuration of the second layer decoding section shown in FIG. 8.

FIG. 9 shows a configuration of second layer decoding section 603 shown in FIG. 8. Second layer decoding section 603 shown in FIG. 9 has shape codebook 701, gain codebook 702, multiplying section 703 and arranging section 704.

Shape codebook 701 selects a shape candidate sh(i,k) based on the shape information included in the second layer encoded data outputted from demultiplexing section 601, and outputs the shape candidate sh(i,k) to multiplying section 703.

Gain codebook 702 selects a gain candidate ga(m) based on the gain information included in the second layer encoded data outputted from demultiplexing section 601, and outputs the gain candidate ga(m) to multiplying section 703.

Multiplying section 703 multiplies the shape candidate sh(i,k) with the gain candidate ga(m), and outputs the result to arranging section 704.

Arranging section 704 arranges the shape candidate after gain candidate multiplication received from multiplying section 703 in the target frequency specified based on the first position information and second position information included in the second layer encoded data outputted from demultiplexing section 601, and outputs the result to adding section 604 as the first layer decoded error transform coefficients.

Figure 10:
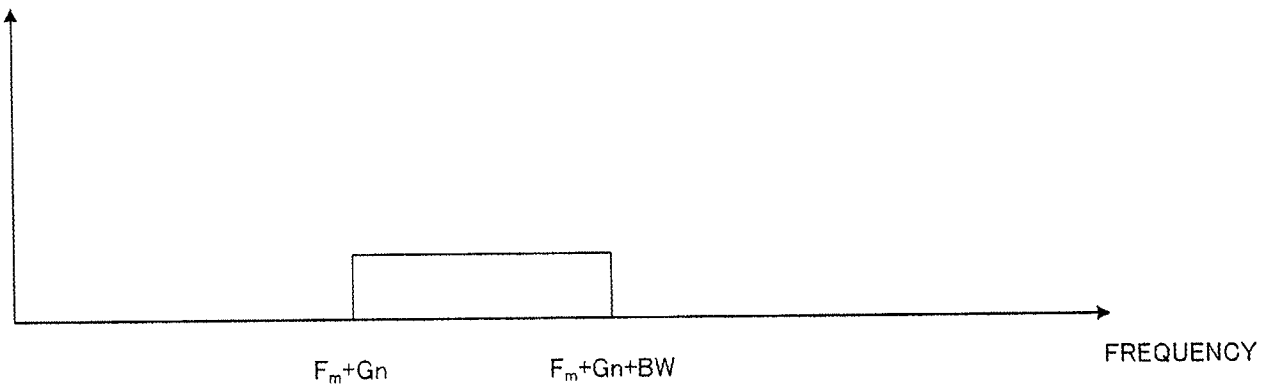
FIG. 10 shows the state of the first layer decoded error transform coefficients outputted from the arranging section shown in FIG. 9.

FIG. 10 shows the state of the first layer decoded error transform coefficients outputted from arranging section 704 shown in FIG. 9. Here, $F_m$ represents the frequency specified based on the first position information and $G_n$ represents the frequency specified in the second position information.

In this way, according to the present embodiment, first position specifying section 201 searches for a band of a great error throughout the full band of an input signal based on predetermined bandwidths and predetermined step sizes to specify the band of a great error, and second position specifying section 202 searches for the target frequency in the band specified in first position specifying section 201 based on narrower bandwidths than the predetermined bandwidths and narrower step sizes than the predetermined step sizes, so that it is possible to accurately specify a bands of a great error from the full band with a small computational complexity and improve sound quality.

Embodiment 2

Figure 11:
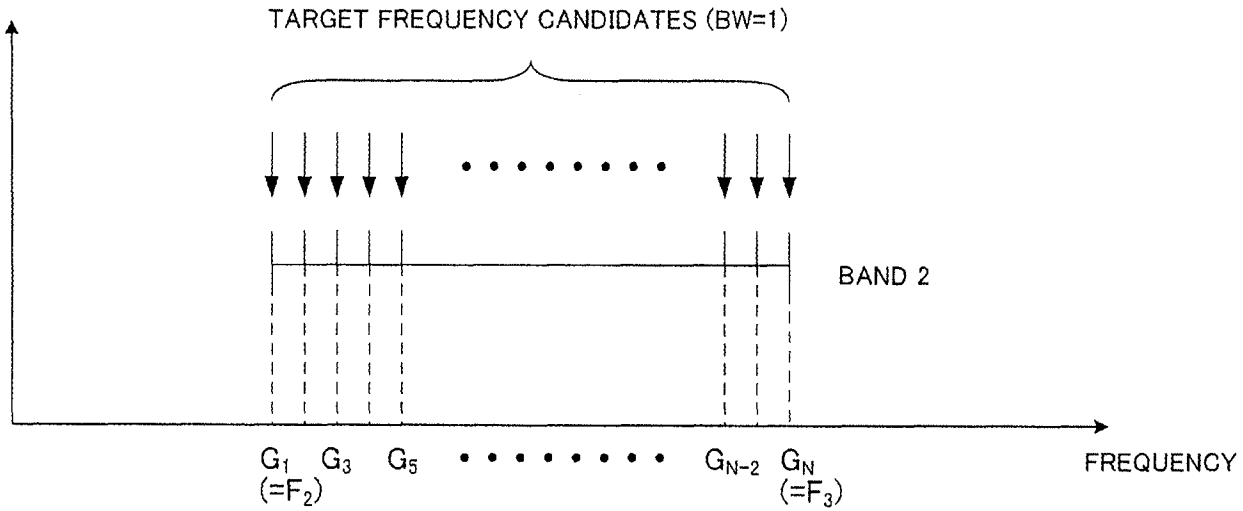
FIG. 11 shows the position of the target frequency specified in the second position specifying section shown in FIG. 3.

Another method of specifying the target frequency band in second position specifying section 202, will be explained with Embodiment 2. FIG. 11 shows the position of the target frequency specified in second position specifying section 202 shown in FIG. 3. The second position specifying section of the encoding apparatus according to the present embodiment differs from the second position specifying section of the encoding apparatus explained in Embodiment 1 in specifying a single target frequency. The shape candidates for error transform coefficients matching a single target frequency is represented by a pulse (or a line spectrum). Further, with the present embodiment, the configuration of the encoding apparatus is the same as the encoding apparatus shown in FIG. 2 except for the internal configuration of encoding section 203, and the configuration of the decoding apparatus is the same as the decoding apparatus shown in FIG. 8 except for the internal configuration of second layer decoding section 603. Therefore, explanation of these will be omitted, and only encoding section 203 related to specifying a second position and second layer decoding section 603 of the decoding apparatus will be explained.

With the present embodiment, second position specifying section 202 specifies a single target frequency in the band specified in first position specifying section 201. Accordingly, with the present embodiment, a single first layer error transform coefficient is selected as the target to be encoded. Here, a case will be explained as an example where first position specifying section 201 specifies band 2. When the bandwidth of the target frequency is BW, BW=1 holds with the present embodiment.

To be more specific, as shown in FIG. 11, with respect to a plurality of target frequency candidates $G_n$ included in band 2, second position specifying section 202 calculates the energy of the first layer error transform coefficient according to above equation 5 or calculates the energy of the first layer error transform coefficient, to which weight is applied taking the characteristics of human perception into account, according to above equation 6. Further, second position specifying section 202 specifies the target frequency $G_n(1 \leq n \leq N)$ that maximizes the calculated energy, and outputs position information of the specified target frequency $G_n$ as second position information to encoding section 203.

Figure 12:
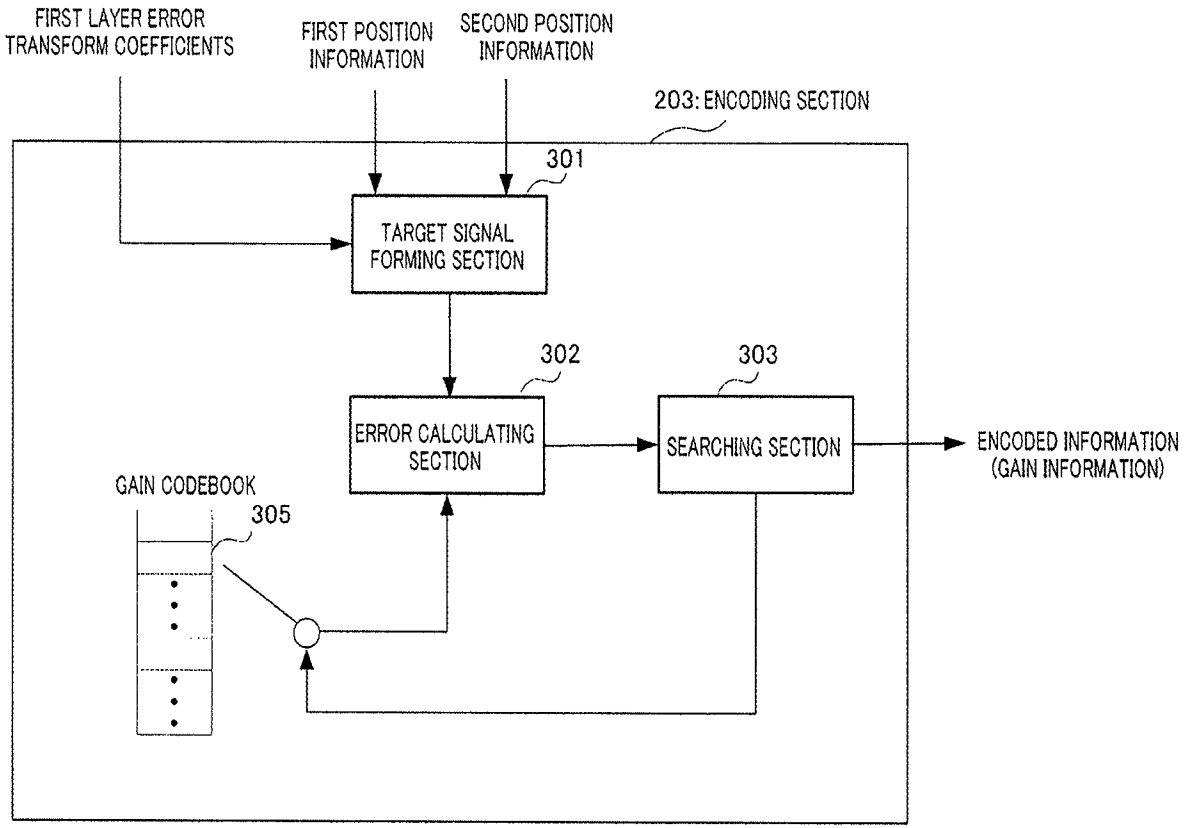
FIG. 12 is a block diagram showing another aspect of the configuration of the encoding section shown in FIG. 7.

FIG. 12 is a block diagram showing another aspect of the configuration of encoding section 203 shown in FIG. 7. Encoding section 203 shown in FIG. 12 employs a configuration removing shape codebook 305 compared to FIG. 7. Further, this configuration supports a case where signals outputted from shape codebook 304 show "1" at all times.

Encoding section 203 encodes the first layer error transform coefficient included in the target frequency $G_n$ specified in second position specifying section 202 to generate encoded information, and outputs the encoded information to multiplexing section 204. Here, a single target frequency is received from second position specifying section 202 and a single first layer error transform coefficient is a target to be encoded, and, consequently, encoding section 203 does not require shape information from shape codebook 304, carries out a search only in gain codebook 305 and outputs gain information of a search result as encoded information to multiplexing section 204.

Figure 13:
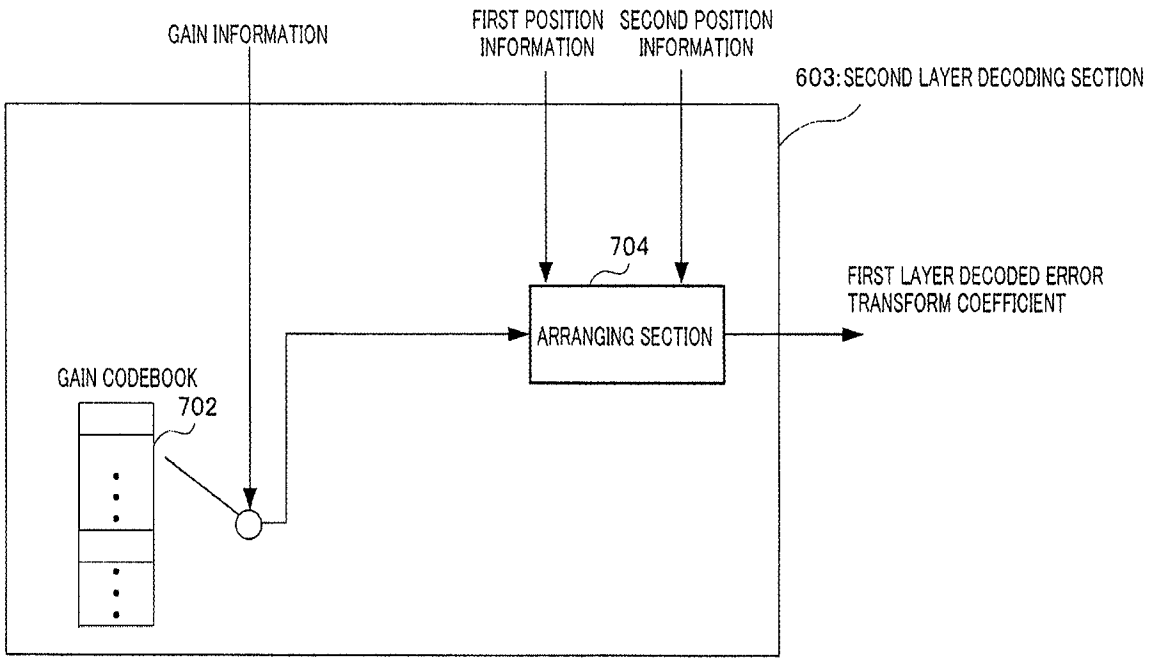
FIG. 13 is a block diagram showing another aspect of the configuration of the second layer decoding section shown in FIG. 9.

FIG. 13 is a block diagram showing another aspect of the configuration of second layer decoding section 603 shown in FIG. 9. Second layer decoding section 603 shown in FIG. 13 employs a configuration removing shape codebook 701 and multiplying section 703 compared to FIG. 9. Further, this configuration supports a case where signals outputted from shape codebook 701 show "1" at all times.

Arranging section 704 arranges the gain candidate selected from the gain codebook based on gain information, in a single target frequency specified based on the first position information and second position information included in the second layer encoded data outputted from demultiplexing section 601, and outputs the result as the first layer decoded error transform coefficient, to adding section 604.

In this way, according to the present embodiment, second position specifying section 202 can represent a line spectrum accurately by specifying a single target frequency in the band specified in first position specifying section 201, so that it is possible to improve the sound quality of signals of strong tonality such as vowels (signals with spectral characteristics in which multiple peaks are observed).

Embodiment 3

Another method of specifying the target frequency bands in the second position specifying section, will be explained with Embodiment 3. Further, with the present embodiment, the configuration of the encoding apparatus is the same as the encoding apparatus shown in FIG. 2 except for the internal configuration of second layer encoding section 105, and, therefore, explanation thereof will be omitted.

Figure 14:
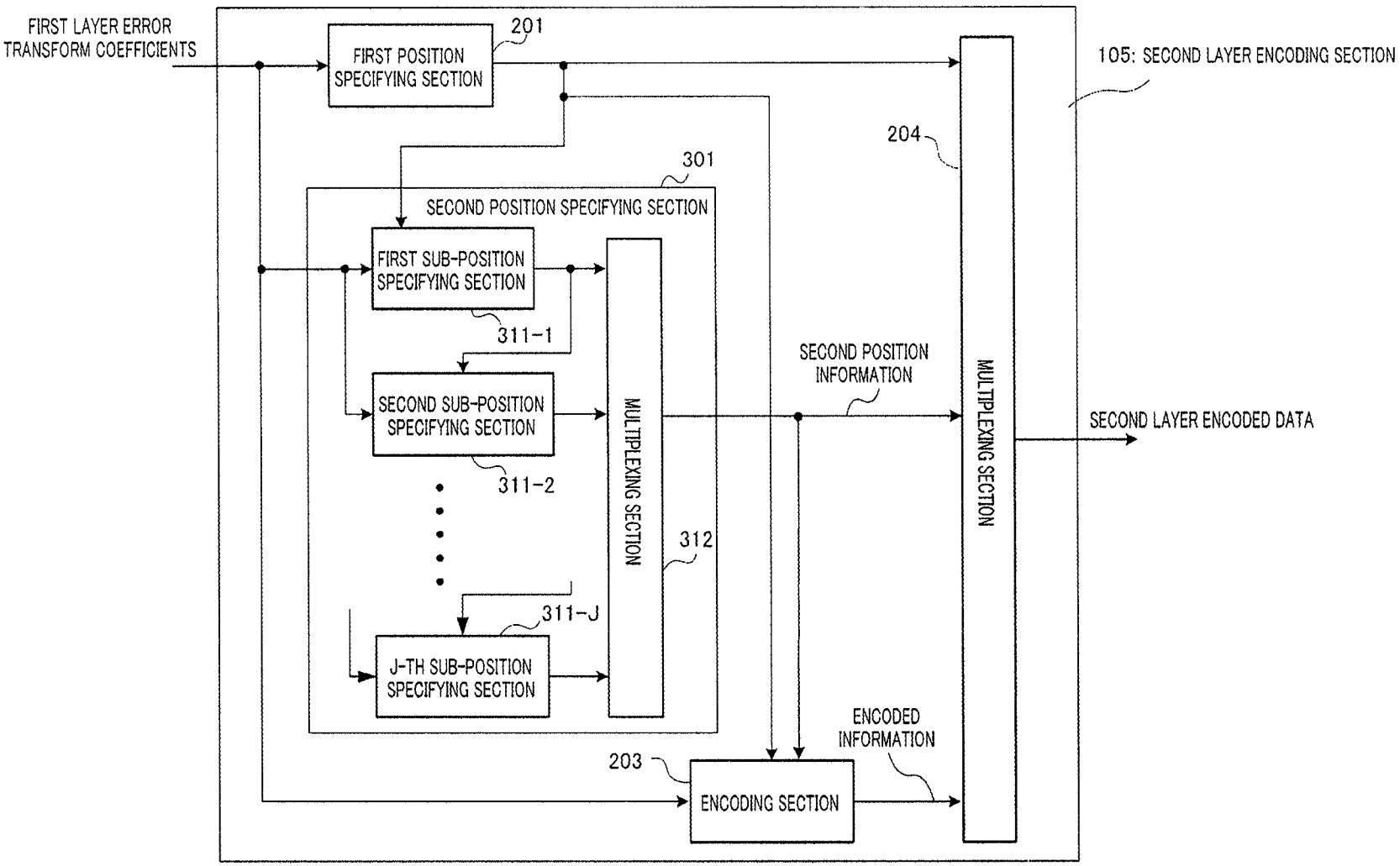
FIG. 14 is a block diagram showing the configuration of the second layer encoding section of the encoding apparatus according to Embodiment 3 of the present invention.

FIG. 14 is a block diagram showing the configuration of second layer encoding section 105 of the encoding apparatus according to the present embodiment. Second layer encoding section 105 shown in FIG. 14 employs a configuration including second position specifying section 301 instead of second position specifying section 202 compared to FIG. 3. The same components as second layer encoding section 105 shown in FIG. 3 will be assigned the same reference numerals, and explanation thereof will be omitted.

Second position specifying section 301 shown in FIG. 14 has first sub-position specifying section 311-1, second sub-position specifying section 311-2, . . . , J-th sub-position specifying section 311-3 and multiplexing section 312.

A plurality of sub-position specifying sections (311-1, . . . , 311-J) specify different target frequencies in the band specified in first position specifying section 201. To be more specific, n-th sub-position specifying section 311-*n* specifies the n-th target frequency, in the band excluding the target frequencies specified in first to (n−1)-th sub-position specifying sections (311-1, . . . , 311-*n*−1) from the band specified in first position specifying section 201.

FIG. 15 shows the positions of the target frequencies specified in a plurality of sub-position specifying sections (311-1, . . . , 311-J) of the encoding apparatus according to the present embodiment. Here, a case will be explained as an example where first position specifying section 201 specifies band 2 and second position specifying section 301 specifies the positions of J target frequencies.

Figure 15A:
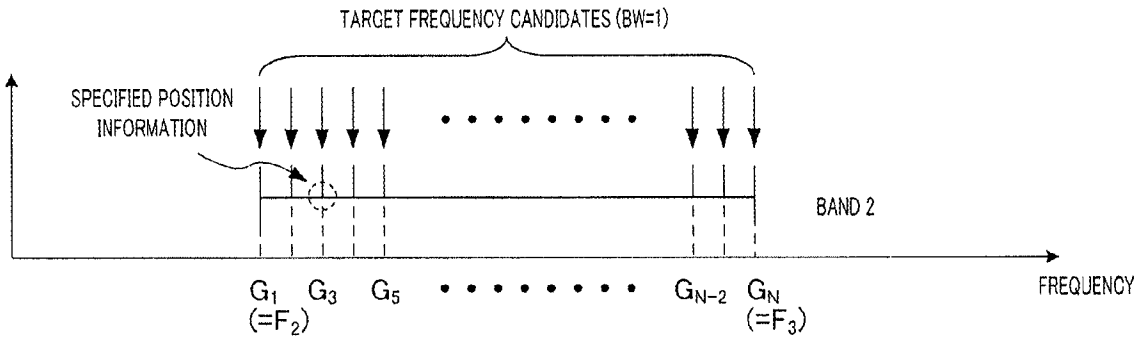
FIGS. 15A-15C show the position of the target frequency specified in a plurality of sub-position specifying sections of the encoding apparatus according to Embodiment 3.

As shown in FIG. 15A, first sub-position specifying section 311-1 specifies a single target frequency from the target frequency candidates in band 2 (here, $G_3$), and outputs position information about this target frequency to multiplexing section 312 and second sub-position specifying section 311-2.

Figure 15B:
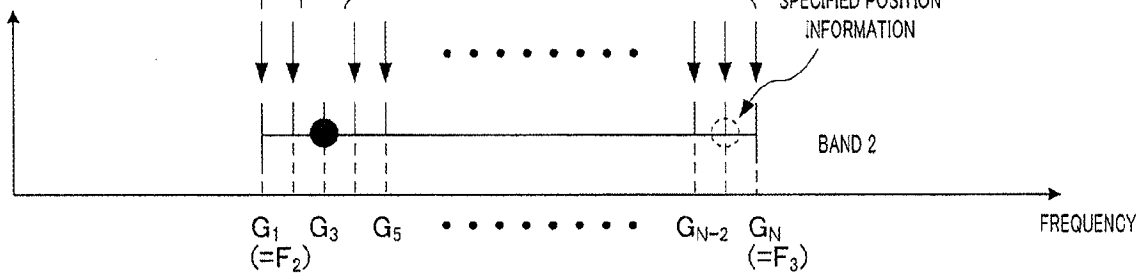

As shown in FIG. 15B, second sub-position specifying section 311-2 specifies a single target frequency (here, $G_{N-1}$) from target frequency candidates, which exclude from band 2 the target frequency $G_3$ specified in first sub-position specifying section 311-1, and outputs position information of the target frequency to multiplexing section 312 and third sub-position specifying section 311-3, respectively.

Figure 15C:
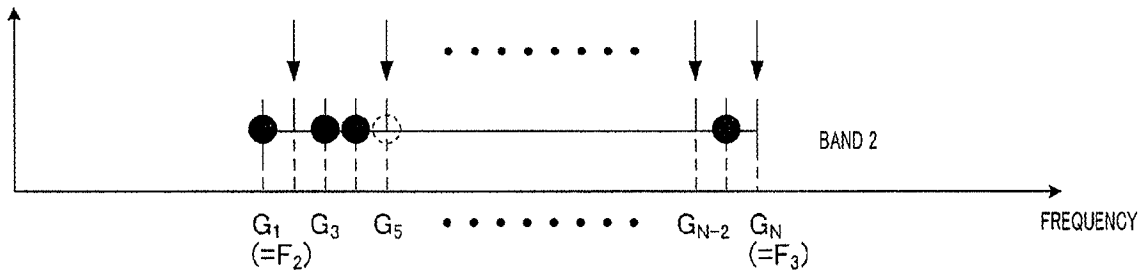

Similarly, as shown in FIG. 15C, J-th sub-position specifying section 311-J selects a single target frequency (here. $G_5$) from target frequency candidates, which exclude from band 2 the (J−1) target frequencies specified in first to (J−1)-th sub-position specifying sections (311-1, . . . , 311-J−1), and outputs position information that specifies this target frequency, to multiplexing section 312.

Multiplexing section 312 multiplexes J items of position information received from sub-position specifying sections (311-1 to 311-J) to generate second position information, and outputs the second position information to encoding section 203 and multiplexing section 204. Meanwhile, this multiplexing section 312 is not indispensable, and J items of position information may be outputted directly to encoding section 203 and multiplexing section 204.

In this way, second position specifying section 301 can represent a plurality of peaks by specifying J target frequencies in the band specified in first position specifying section 201, so that it is possible to further improve sound quality of signals of strong tonality such as vowels. Further, only J target frequencies need to be determined from the band specified in first position specifying section 201, so that it is possible to significantly reduce the number of combinations of a plurality of target frequencies compared to the case where J target frequencies are determined from a full band. By this means, it is possible to make the bit rate lower and the computational complexity lower.

Embodiment 4

Another encoding method in second layer encoding section 105 will be explained with Embodiment 4. Further, with the present embodiment, the configuration of the encoding apparatus is the same as the encoding apparatus shown in FIG. 2 except for the internal configuration of second layer encoding section 105, and explanation thereof will be omitted.

Figure 16:
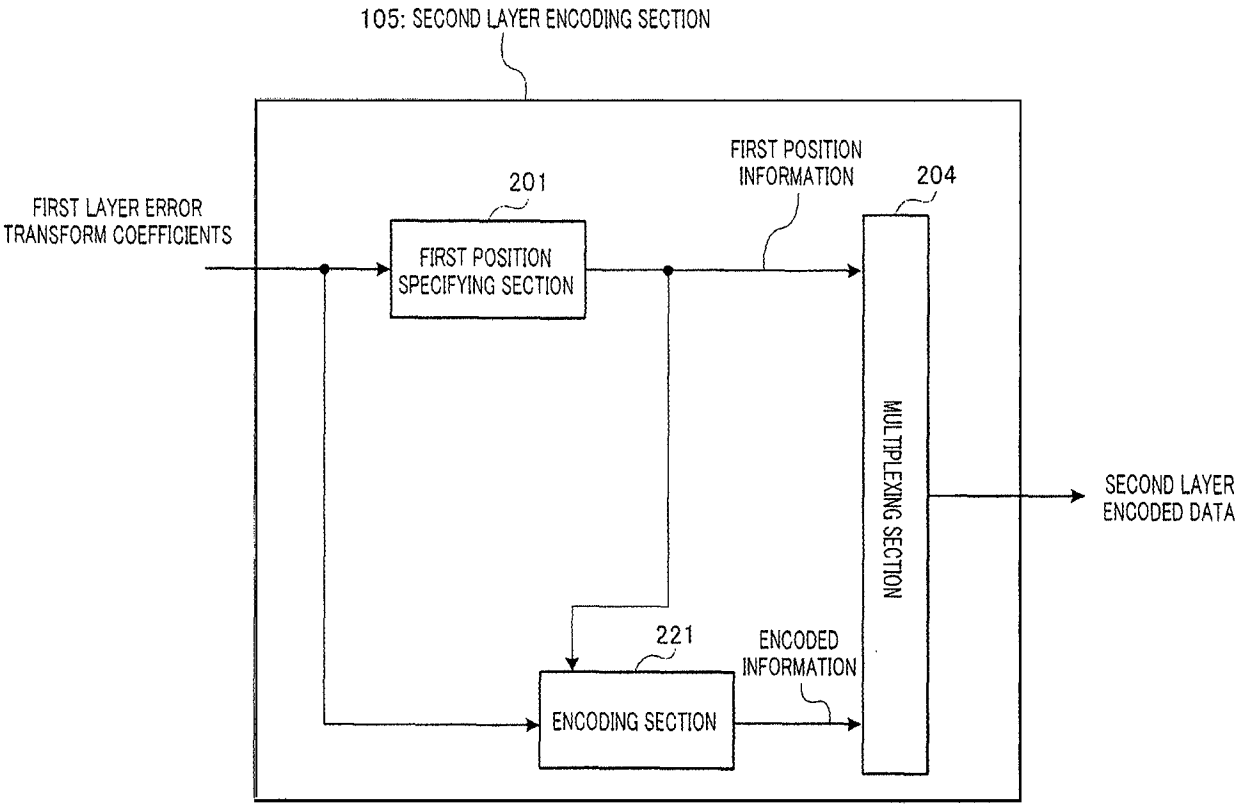
FIG. 16 is a block diagram showing the configuration of the second layer encoding section of the encoding apparatus according to Embodiment 4 of the present invention.

FIG. 16 is a block diagram showing another aspect of the configuration of second layer encoding section 105 of the encoding apparatus according to the present embodiment. Second layer encoding section 105 shown in FIG. 16 employs a configuration further including encoding section 221 instead of encoding section 203 shown in FIG. 3, without second position specifying section 202 shown in FIG. 3.

Encoding section 221 determines second position information such that the quantization distortion, produced when the error transform coefficients included in the target frequency are encoded, is minimized. This second position information is stored in second position information codebook 321.

Figure 17:
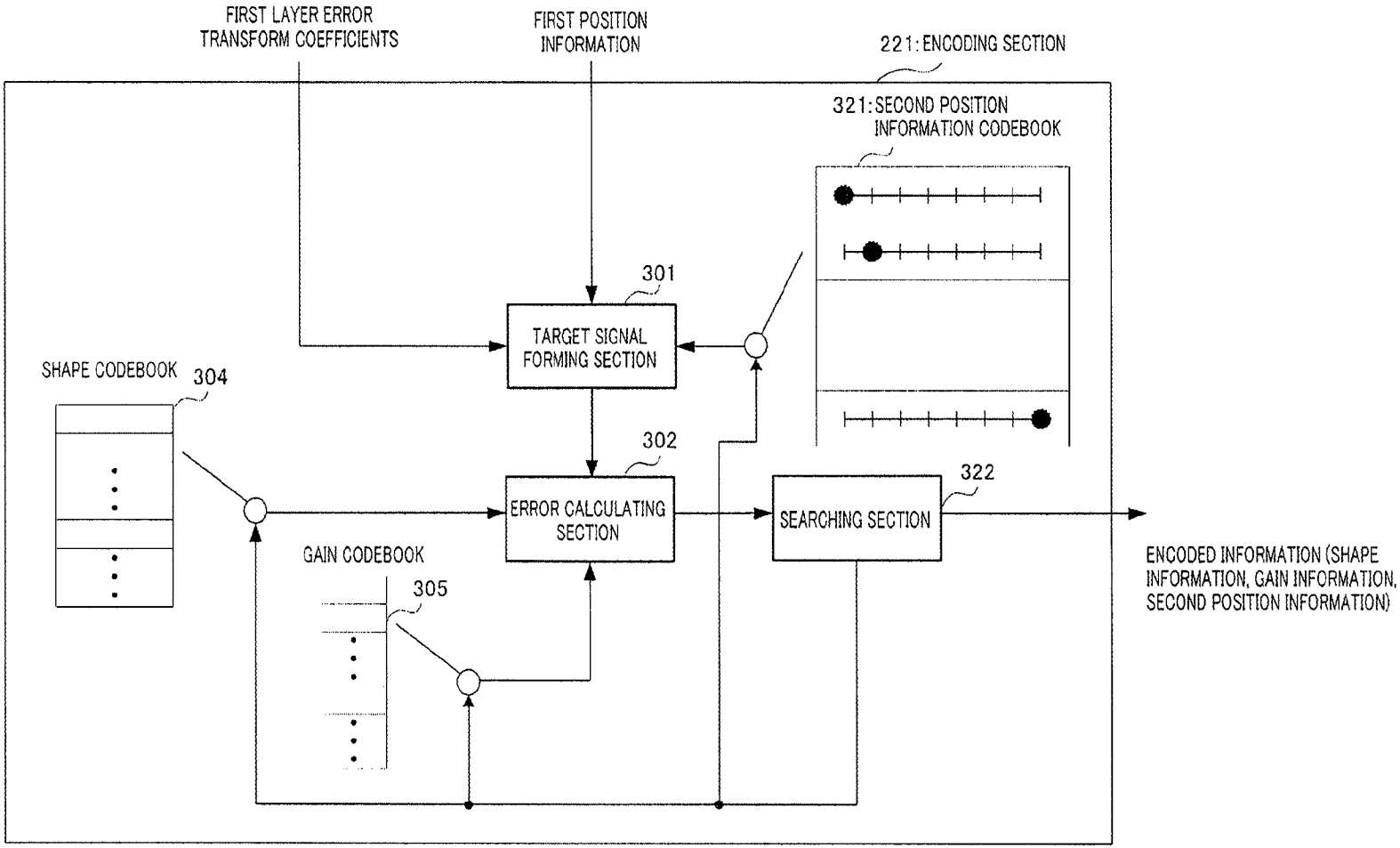
FIG. 17 is a block diagram showing the configuration of the encoding section shown in FIG. 16.

FIG. 17 is a block diagram showing the configuration of encoding section 221 shown in FIG. 16. Encoding section 221 shown in FIG. 17 employs a configuration including searching section 322 instead of searching section 303 with an addition of second position information codebook 321 compared to encoding section 203 shown in FIG. 7. Further, the same components as in encoding section 203 shown in FIG. 7 will be assigned the same reference numerals, and explanation thereof will be omitted.

Second position information codebook 321 selects a piece of second position information from the stored second position information candidates according to a control signal from searching section 322 (described later), and outputs the second position information to target signal forming section 301. In second position information codebook 321 in FIG. 17, the black circles represent the positions of the target frequencies of the second position information candidates.

Target signal forming section 301 specifies the target frequency using the first position information received from first position specifying section 201 and the second position information selected in second position information codebook 321, extracts a portion included in the specified target frequency from the first layer error transform coefficients received from subtracting section 104, and outputs the extracted first layer error transform coefficients as the target signal to error calculating section 302.

Searching section 322 searches for the combination of a shape candidate, a gain candidate and second position information candidates that minimizes the error E, based on the error E received from error calculating section 302, and outputs the shape information, gain information and second position information of the search result as encoded information to multiplexing section 204 shown in FIG. 16. Further, searching section 322 outputs to second position information codebook 321 a control signal for selecting and outputting a second position information candidate to target signal forming section 301.

In this way, according to the present embodiment, second position information is determined such that quantization distortion produced when error transform coefficients included in the target frequency, is minimized and, consequently, the final quantization distortion becomes little, so that it is possible to improve speech quality.

Figure 18:
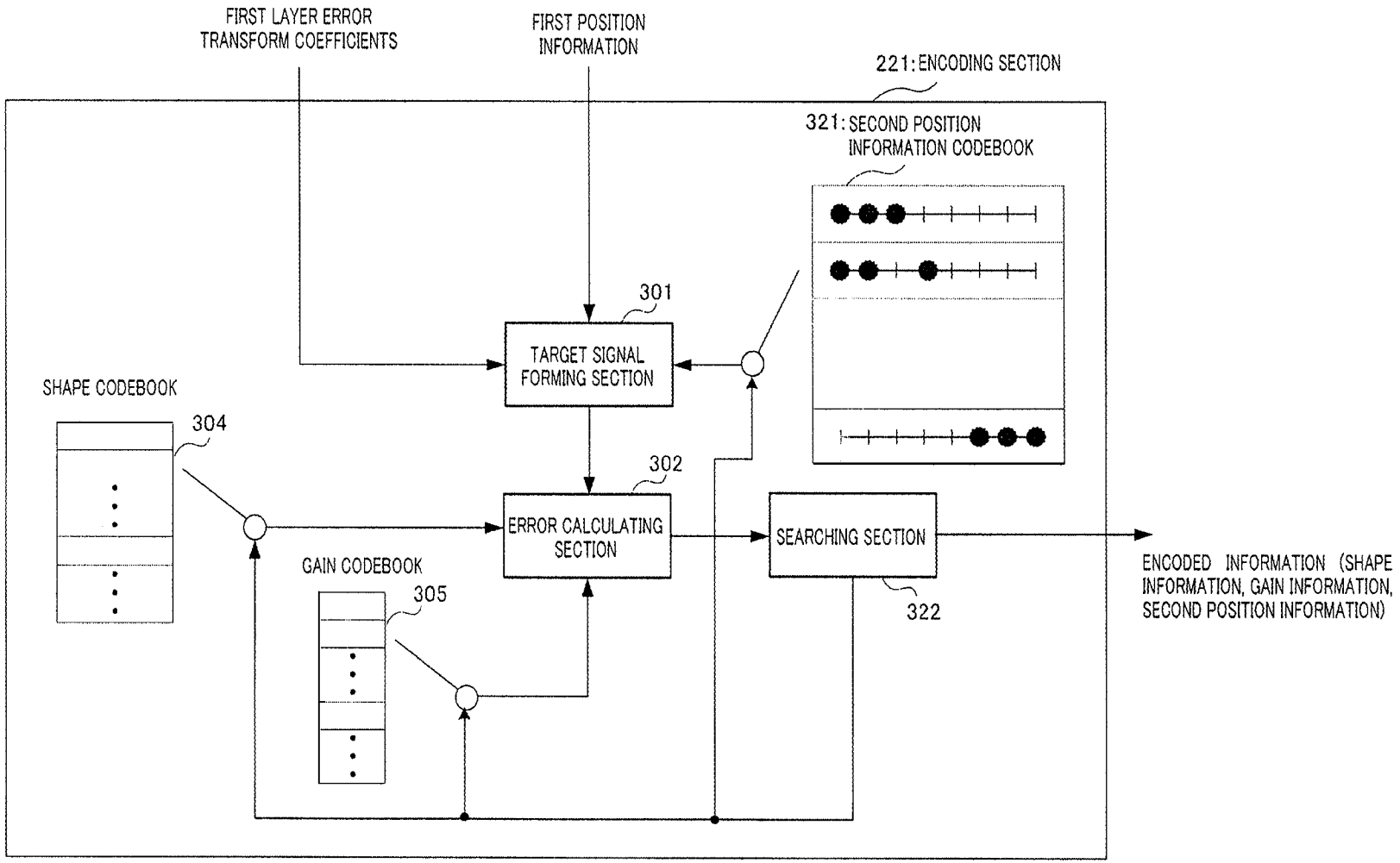
FIG. 18 shows an encoding section in case where the second position information candidates stored in the second position information codebook in FIG. 17 each have three target frequencies.

Further, although an example has been explained with the present embodiment where second position information codebook 321 shown in FIG. 17 stores second position information candidates in which there is a single target frequency as an element, the present invention is not limited to this, and second position information codebook 321 may store second position information candidates in which there are a plurality of target frequencies as elements as shown in FIG. 18. FIG. 18 shows encoding section 221 in case where second position information candidates stored in second position information codebook 321 each include three target frequencies.

Figure 19:
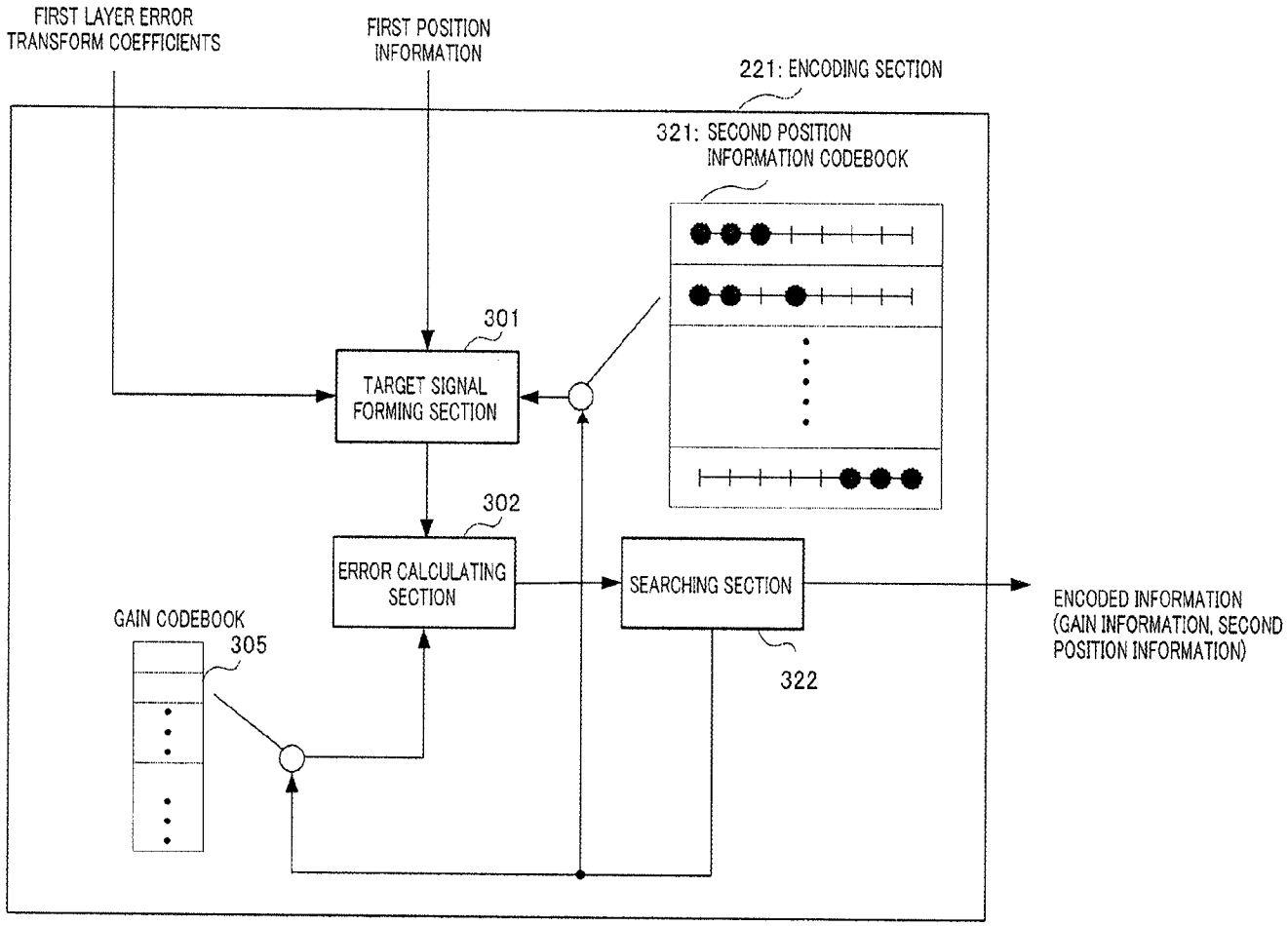
FIG. 19 is a block diagram showing another configuration of the encoding section shown in FIG. 16.

Further, although an example has been explained with the present embodiment where error calculating section 302 shown in FIG. 17 calculates the error E based on shape codebook 304 and gain codebook 305, the present invention is not limited to this, and the error E may be calculated based on gain codebook 305 alone without shape codebook 304. FIG. 19 is a block diagram showing another configuration of encoding section 221 shown in FIG. 16. This configuration supports the case where signals outputted from shape codebook 304 show "1" at all times. In this case, the shape is formed with a plurality of pulses and shape codebook 304 is not required, so that searching section 322 carries out a search only in gain codebook 305 and second position information codebook 321 and outputs gain information and second position information of the search result as encoded information, to multiplexing section 204 shown in FIG. 16.

Further, although the present embodiment has been explained assuming that second position information codebook 321 adopts mode of actually securing the storing space and storing second position information candidates, the present invention is not limited to this, and second position information codebook 321 may generate second position information candidates according to predetermined processing steps. In this case, storing space is not required in second position information codebook 321.

Embodiment 5

Another method of specifying a band in the first position specifying section will be explained with Embodiment 5. Further, with the present embodiment, the configuration of the encoding apparatus is the same as the encoding apparatus shown in FIG. 2 except for the internal configuration of second layer encoding section 105 and, therefore, explanation thereof will be omitted.

Figure 20:
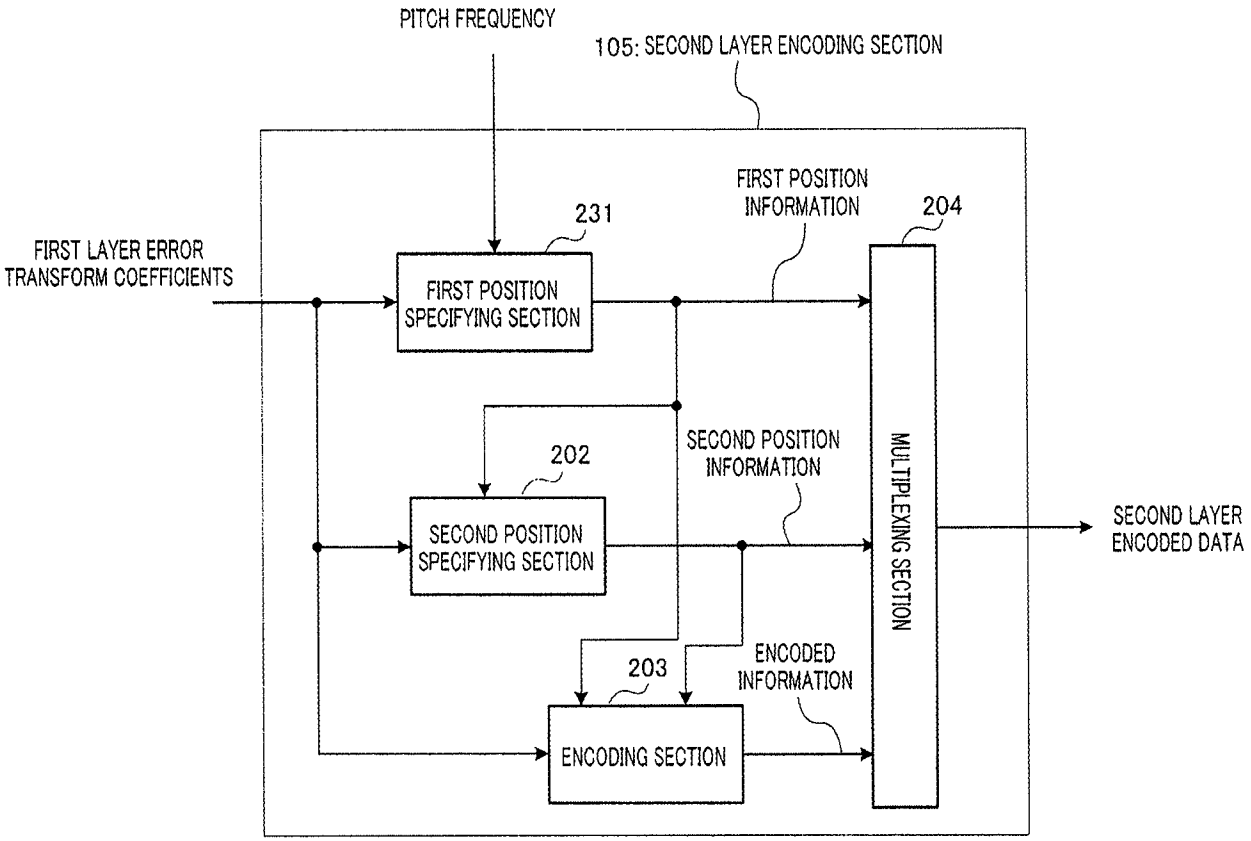
FIG. 20 is a block diagram showing the configuration of the second layer encoding section according to Embodiment 5 of the present invention.

FIG. 20 is a block diagram showing the configuration of second layer encoding section 105 of the encoding apparatus according to the present embodiment. Second layer encoding section 105 shown in FIG. 20 employs the configuration including first position specifying section 231 instead of first position specifying section 201 shown in FIG. 3.

A calculating section (not shown) performs a pitch analysis with respect to an input signal to find the pitch period, and calculates the pitch frequency based on the reciprocal of the found pitch period. Further, the calculating section may calculate the pitch frequency based on the first layer encoded data produced in encoding processing in first layer encoding section 102. In this case, first layer encoded data is transmitted and, therefore, information for specifying the pitch frequency needs not to be transmitted additionally. Further, the calculating section outputs pitch period information for specifying the pitch frequency, to multiplexing section 106.

First position specifying section 231 specifies a band of a predetermined relatively wide bandwidth, based on the pitch frequency received from the calculating section (not shown), and outputs position information of the specified band as the first position information, to second position specifying section 202, encoding section 203 and multiplexing section 204.

Figure 21:
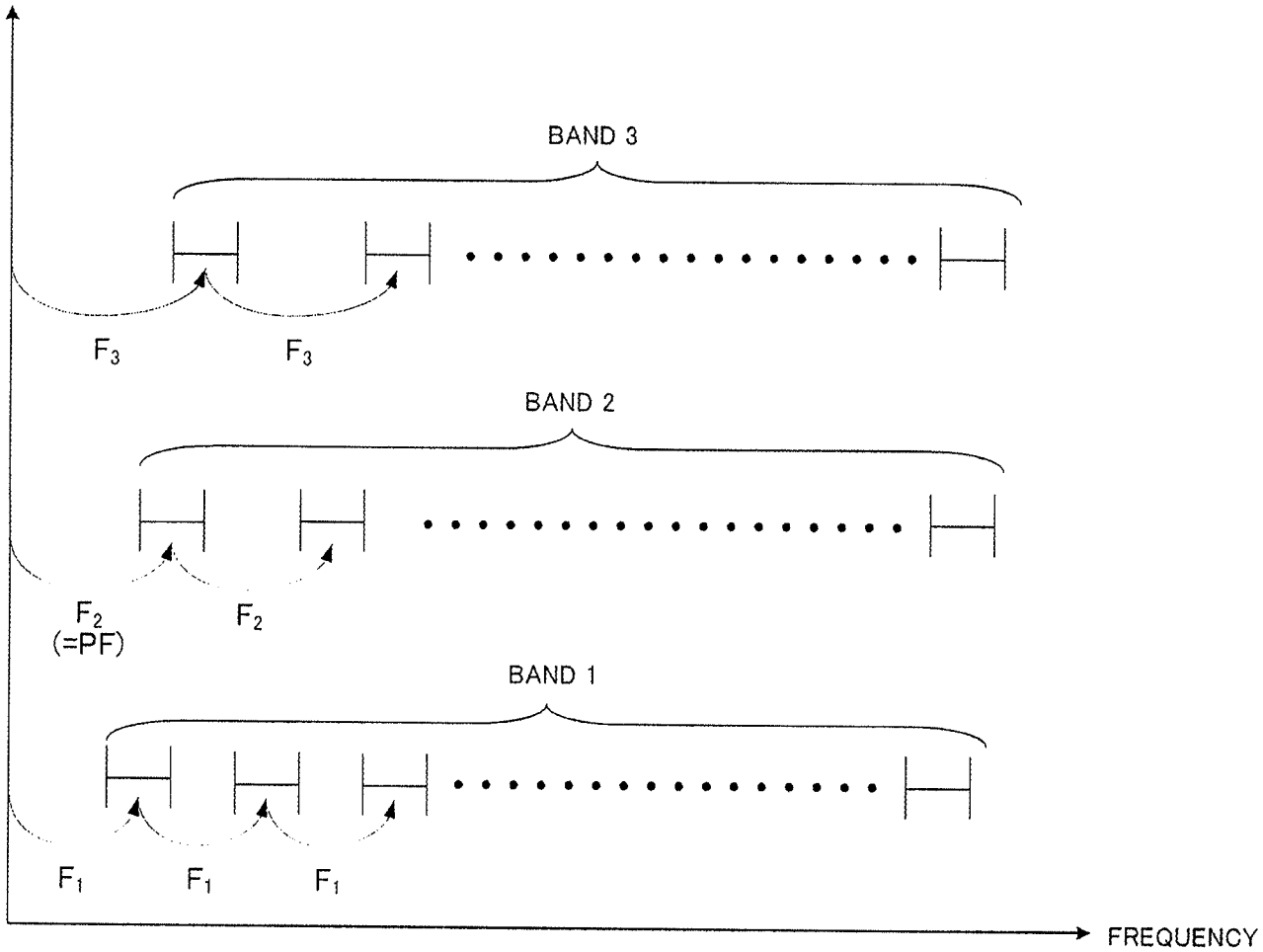
FIG. 21 shows the position of a band specified in the first position specifying section shown in FIG. 20.

FIG. 21 shows the position of the band specified in first position specifying section 231 shown in FIG. 20. The three bands shown in FIG. 21 are in the vicinities of the bands of integral multiples of reference frequencies $F_1$ to $F_3$, determined based on the pitch frequency PF to be inputted. The reference frequencies are determined by adding predetermined values to the pitch frequency PF. As a specific example, values of the reference frequencies add −1, 0 and 1 to the PF, and the reference frequencies meet $F_1$=PF−1, $F_2$=PF and $F_3$=PF+1.

The bands are set based on integral multiples of the pitch frequency because a speech signal has characteristic (either the harmonic structure or harmonics) where peaks rise in a spectrum in the vicinity of integral multiples of the reciprocal of the pitch period (i.e., pitch frequency) particularly in the vowel portion of the strong pitch periodicity, and the first layer error transform coefficients are likely to produce a significant error is in the vicinity of integral multiples of the pitch frequency In this way, according to the present embodiment, first position specifying section 231 specifies the band in the vicinity of integral multiples of the pitch frequency and, consequently, second position specifying section 202 eventually specifies the target frequency in the vicinity of the pitch frequency, so that it is possible to improve speech quality with a small computational complexity.

Embodiment 6

Figure 22:
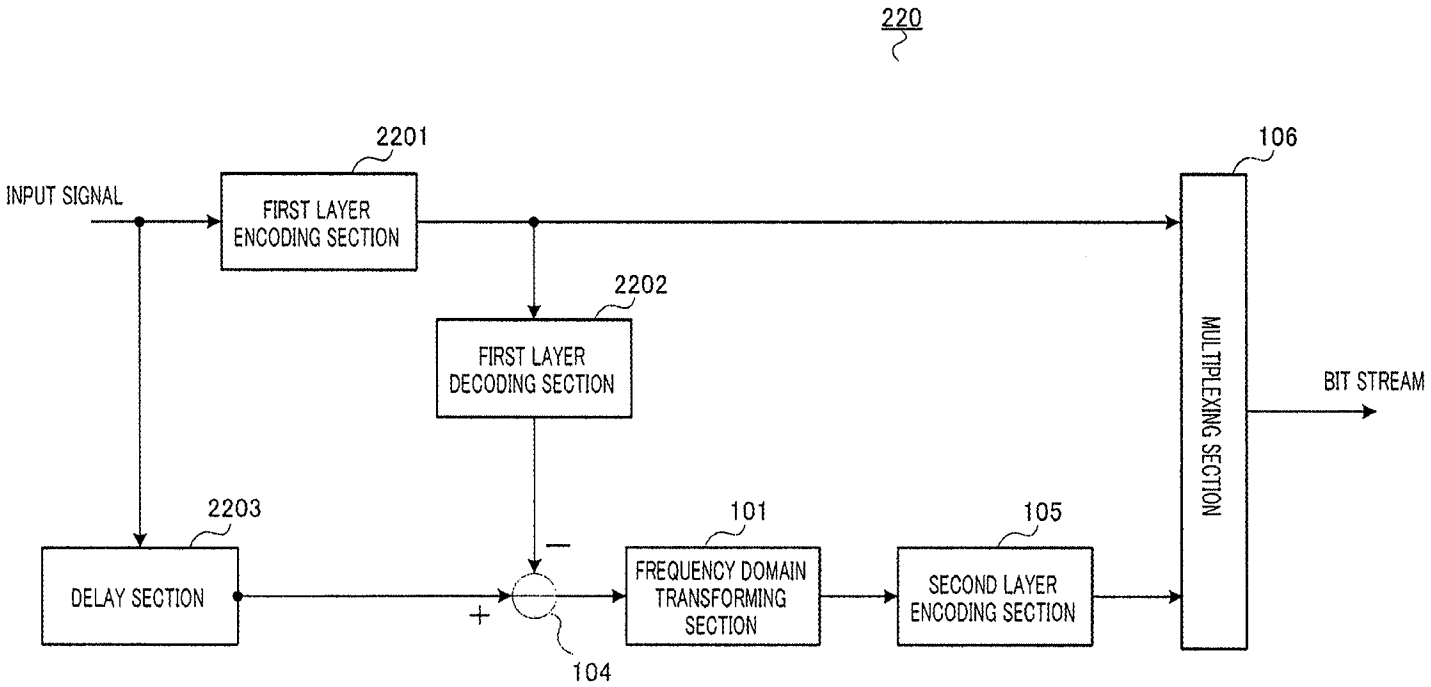
FIG. 22 is a block diagram showing the main configuration of the encoding apparatus according to Embodiment 6.

A case will be explained with Embodiment 6 where the encoding method according to the present invention is applied to the encoding apparatus that has a first layer encoding section using a method for substituting an approximate signal such as noise for a high frequency band. FIG. 22 is a block diagram showing the main configuration of encoding apparatus 220 according to the present embodiment. Encoding apparatus 220 shown in FIG. 22 has first layer encoding section 2201, first layer decoding section 2202, delay section 2203, subtracting section 104, frequency domain transforming section 1-01, second layer encoding section 105 and multiplexing section 106. Further, in encoding apparatus 220 in FIG. 22, the same components as encoding apparatus 100 shown in FIG. 2 will be assigned the same reference numerals, and explanation thereof will be omitted.

First layer encoding section 2201 of the present embodiment employs a scheme of substituting an approximate signal such as noise for a high frequency band. To be more specific, by representing a high frequency band of low perceptual importance by an approximate signal and, instead, increasing the number of bits to be allocated in a low frequency band (or middle-low frequency band) of perceptual importance, fidelity of this band is improved with respect to the original signal. By this means, overall sound quality improvement is realized. For example, there are an AMR-WB scheme (Non-Patent Document 3) or VMR-WB scheme (Non-Patent Document 4).

First layer encoding section 2201 encodes an input signal to generate first layer encoded data, and outputs the first layer encoded data to multiplexing section 106 and first layer decoding section 2202. Further, first layer encoding section 2201 will be described in detail later.

First layer decoding section 2202 performs decoding processing using the first layer encoded data received from first layer encoding section 2201 to generate the first layer decoded signal, and outputs the first layer decoded signal to subtracting section 104. Further, first layer decoding section 2202 will be described in detail later.

Figure 23:
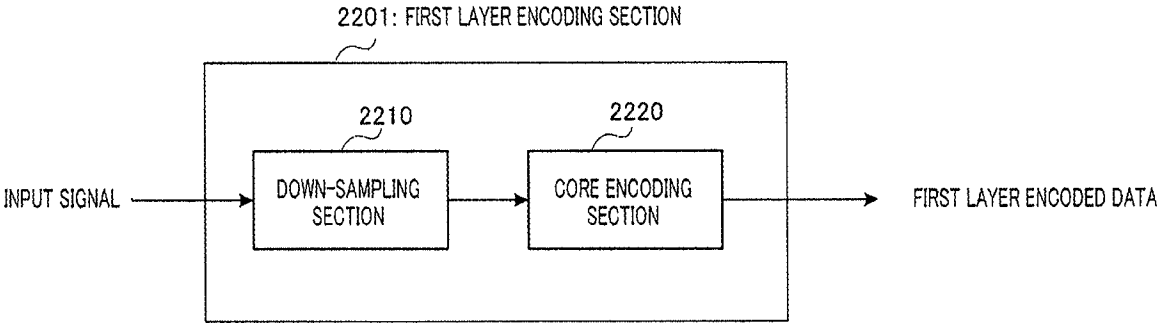
FIG. 23 is a block diagram showing the configuration of the first layer encoding section of the encoding apparatus shown in FIG. 22.

Next, first layer encoding section 2201 will be explained in detail using FIG. 23. FIG. 23 is a block diagram showing the configuration of first layer encoding section 2201 of encoding apparatus 220. As shown in FIG. 23, first layer encoding section 2201 is constituted by down-sampling section 2210 and core encoding section 2220.

Down-sampling section 2210 down-samples the time domain input signal to convert the sampling rate of the time domain input signal into a desired sampling rate, and outputs the down-sampled time domain signal to core encoding section 2220.

Core encoding section 2220 performs encoding processing with respect to the output signal of down-sampling section 2210 to generate first layer encoded data, and outputs the first layer encoded data to first layer decoding section 2202 and multiplexing section 106.

Figure 24:
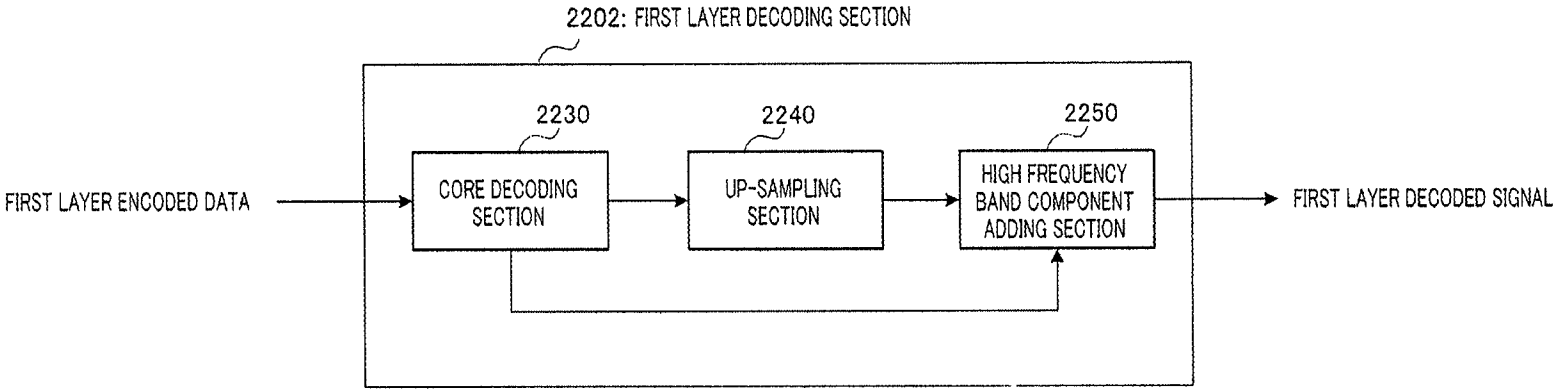
FIG. 24 is a block diagram showing the configuration of the first layer decoding section of the encoding apparatus shown in FIG. 22.

Next, first layer decoding section 2202 will be explained in detail using FIG. 24. FIG. 24 is a block diagram showing the configuration of first layer decoding section 2202 of encoding apparatus 220. As shown in FIG. 24, first layer decoding section 2202 is constituted by core decoding section 2230, up-sampling section 2240 and high frequency band component adding section 2250.

Core decoding section 2230 performs decoding processing using the first layer encoded data received from core encoding section 2220 to generate a decoded signal, and outputs the decoded signal to up-sampling section 2240 and outputs the decoded LPC coefficients determined in decoding processing, to high frequency band component adding section 2250.

Up-sampling section 2240 up-samples the decoded signal outputted from core decoding section 2230, to convert the sampling rate of the decoded signal into the same sampling rate as the input signal, and outputs the up-sampled signal to high frequency band component adding section 2250.

High frequency band component adding section 2250 generates an approximate signal for high frequency band components according to the methods disclosed in, for example, Non-Patent Document 3 and Non-Patent Document 4, with respect to the signal up-sampled in up-sampling section 2240, and compensates a missing high frequency band.

Figure 25:
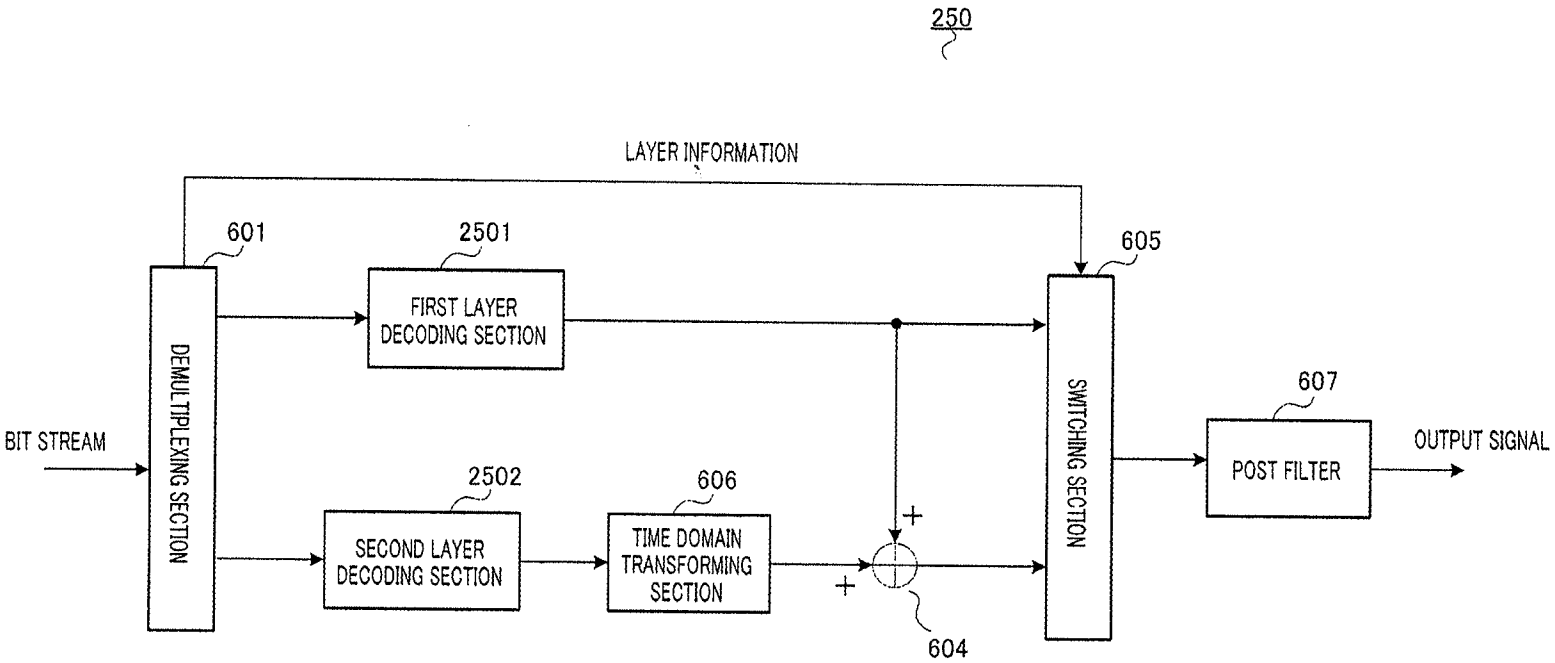
FIG. 25 is a block diagram showing the main configuration of the decoding apparatus supporting the encoding apparatus shown in FIG. 22.

FIG. 25 is a block diagram showing the main configuration of the decoding apparatus that supports the encoding apparatus according to the present embodiment. Decoding apparatus 250 in FIG. 25 has the same basic configuration as decoding apparatus 600 shown in FIG. 8, and has first layer decoding section 2501 instead of first layer decoding section 602. Similar to first layer decoding section 2202 of the encoding apparatus, first layer decoding section 2501 is constituted by a core decoding section, up-sampling section and high frequency band component adding section (not shown). Here, detailed explanation of these components will be omitted.

A signal that can be generated like a noise signal in the encoding section and decoding section without additional information, is applied to a the synthesis filter formed with the decoded LPC coefficients given by the core decoding section, so that the output signal of the synthesis filter is used as an approximate signal for the high frequency band component. At this time, the high frequency band component of the input signal and the high frequency band component of the first layer decoded signal show completely different waveforms, and, therefore, the energy of the high frequency band component of an error signal calculated in the subtracting section becomes greater than the energy of high frequency band component of the input signal. As a result of this, a problem takes place in the second layer encoding section in which the band arranged in a high frequency band of low perceptual importance is likely to be selected.

According to the present embodiment, encoding apparatus 220 that uses the method of substituting an approximate signal such as noise for the high frequency band as described above in encoding processing in first layer encoding section 2201, selects a band from a low frequency band of a lower frequency than the reference frequency set in advance and, consequently, can select a low frequency band of high perceptual importance as the target to be encoded by the second layer encoding section even when the energy of a high frequency band of an error signal (or error transform coefficients) increases, so that it is possible to improve sound quality.

Further, although a configuration has been explained above as an example where information related to a high frequency band is not transmitted to the decoding section, the present invention is not limited to this, and, for example, a configuration may be possible where, as disclosed in Non-Patent Document 5, a signal of a high frequency band is encoded at a low bit rate compared to a low frequency band and is transmitted to the decoding section.

Further, although, in encoding apparatus 220 shown in FIG. 22, subtracting section 104 is configured to find difference between time domain signals, the subtracting section may be configured to find difference between frequency domain transform coefficients. In this case, input transform coefficients are found by arranging frequency domain transforming section 101 between delay section 2203 and subtracting section 104, and the first layer decoded transform coefficients are found by newly adding frequency domain transforming section 101 between first layer decoding section 2202 and subtracting section 104. In this way, subtracting section 104 is configured to find the difference between the input transform coefficients and the first layer decoded transform coefficients and to give the error transform coefficients directly to the second layer encoding section. This configuration enables subtracting processing adequate to each band by finding difference in a given band and not finding difference in other bands, so that it is possible to further improve sound quality.

Embodiment 7

Figure 26:
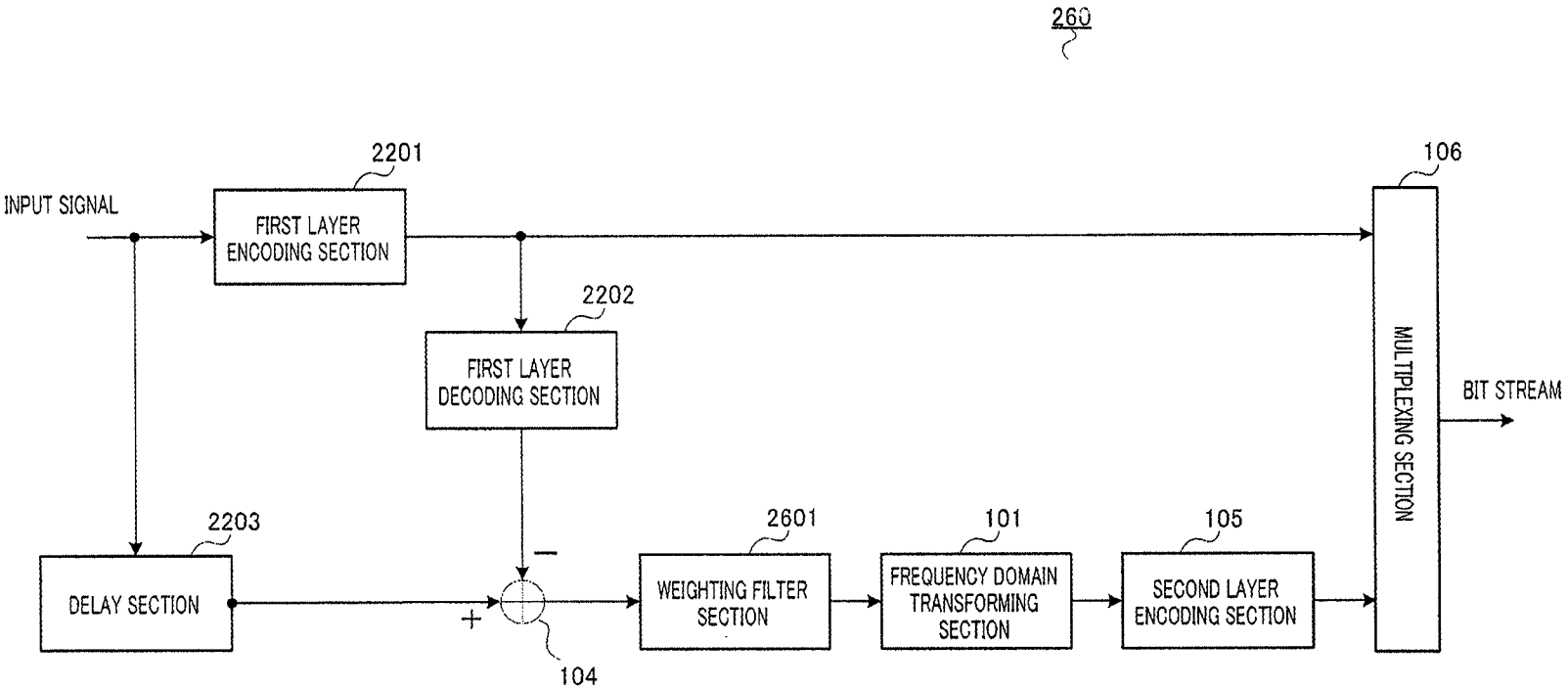
FIG. 26 is a block diagram showing the main configuration of the encoding apparatus according to Embodiment 7.

A case will be explained with Embodiment 7 where the encoding apparatus and decoding apparatus of another configuration adopts the encoding method according to the present invention. FIG. 26 is a block diagram showing the main configuration of encoding apparatus 260 according to the present embodiment.

Encoding apparatus 260 shown in FIG. 26 employs a configuration with an addition of weighting filter section 2601 compared to encoding apparatus 220 shown in FIG. 22. Further, in encoding apparatus 260 in FIG. 26, the same components as in FIG. 22 will be assigned the same reference numerals, and explanation thereof will be omitted.

Weighting filter section 2601 performs filtering processing of applying perceptual weight to an error signal received from subtracting section 104, and outputs the signal after filtering processing, to frequency domain transforming section 101. Weighting filter section 2601 has opposite spectral characteristics to the spectral envelope of the input signal, and smoothes (makes white) the spectrum of the input signal or changes it to spectral characteristics similar to the smoothed spectrum of the input signal. For example, the weighting filter W(z) is configured as represented by following equation 9 using the decoded LPC coefficients acquired in first layer decoding section 2202.

(Equation 9)

$$W(z) = 1 - \sum_{i=1}^{NP} \alpha(i) \cdot \gamma^i \cdot z^{-i} \quad [9]$$

Here, $\alpha(i)$ is the decoded LPC coefficients, NP is the order of the LPC coefficients, and $\gamma$ is a parameter for controlling the degree of smoothing (i.e. the degree of making the spectrum white) the spectrum and assumes values in the range of $0 \leq \gamma \leq 1$. When $\gamma$ is greater, the degree of smoothing becomes greater, and 0.92, for example, is used for $\gamma$.

Figure 27:
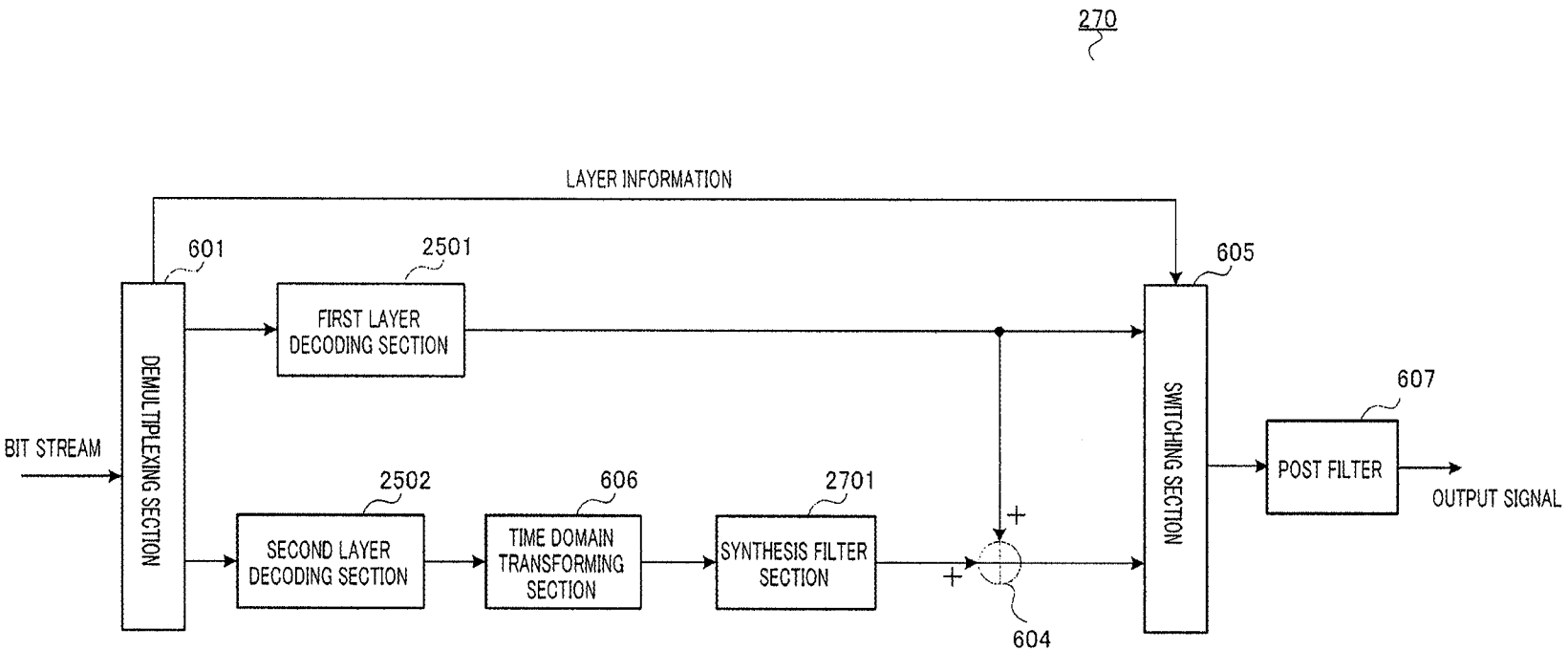
FIG. 27 is a block diagram showing the main configuration of the decoding apparatus supporting the encoding apparatus shown in FIG. 26.

Decoding apparatus 270 shown in FIG. 27 employs a configuration with an addition of synthesis filter section 2701 compared to decoding apparatus 250 shown in FIG. 25. Further, in decoding apparatus 270 in FIG. 27, the same components as in FIG. 25 will be assigned the same reference numerals, and explanation thereof will be omitted.

Synthesis filter section 2701 performs filtering processing of restoring the characteristics of the smoothed spectrum back to the original characteristics, with respect to a signal received from time domain transforming section 606, and outputs the signal after filtering processing to adding section 604. Synthesis filter section 2701 has the opposite spectral characteristics to the weighting filter represented in equation 9, that is, the same characteristics as the spectral envelope of the input signal. The synthesis filter B(z) is represented as in following equation 10 using equation 9.

(Equation 10)

$$B(z) = 1 / W(z) = \frac{1}{1 - \sum_{i=1}^{NP} \alpha(i) \cdot \gamma^i \cdot z^{-i}} \quad [10]$$

Here, $\alpha(i)$ is the decoded LPC coefficients, NP is the order of the LPC coefficients, and $\gamma$ is a parameter for controlling the degree of spectral smoothing (i.e. the degree of making the spectrum white) and assumes values in the range of $0 \leq \gamma \leq 1$. When $\gamma$ is greater, the degree of smoothing becomes greater, and 0.92, for example, is used for $\gamma$.

Generally, in the above-described encoding apparatus and decoding apparatus, greater energy appears in a low frequency band than in a high frequency band in the spectral envelope of a speech signal, so that, even when the low frequency band and the high frequency band have equal coding distortion of a signal before this signal passes the synthesis filter, coding distortion becomes greater in the low frequency band after this signal passes the synthesis filter. In case where a speech signal is compressed to a low bit rate and transmitted, coding distortion cannot be reduced much, and, therefore, energy of a low frequency band containing coding distortion increases due to the influence of the synthesis filter of the decoding section as described above and there is a problem that quality deterioration is likely to occur in a low frequency band.

According to the encoding method of the present embodiment, the target frequency is determined from a low frequency band placed in a lower frequency than the reference frequency, and, consequently, the low frequency band is likely to be selected as the target to be encoded by second layer encoding section 105, so that it is possible to minimize coding distortion in the low frequency band. That is, according to the present embodiment, although a synthesis filter emphasizes a low frequency band, coding distortion in the low frequency band becomes difficult to perceive, so that it is possible to provide an advantage of improving sound quality.

Further, although subtracting section 104 of encoding apparatus 260 is configured with the present embodiment to find errors between time domain signals, the present invention is not limited to this, and subtracting section 104 may be configured to find errors between frequency domain transform coefficients. To be more specific, the input transform coefficients are found by arranging weighting filter section 2601 and frequency domain transforming section 101 between delay section 2203 and subtracting section 104, and the first layer decoded transform coefficients are found by newly adding weighting filter section 2601 and frequency domain transforming section 101 between first layer decoding section 2202 and subtracting section 104. Moreover, subtracting section 104 is configured to find the error between the input transform coefficients and the first layer decoded transform coefficients and give this error transform coefficients directly to second layer encoding section 105. This configuration enables subtracting processing adequate to each band by finding errors in a given band and not finding errors in other bands, so that it is possible to further improve sound quality.

Figure 28:
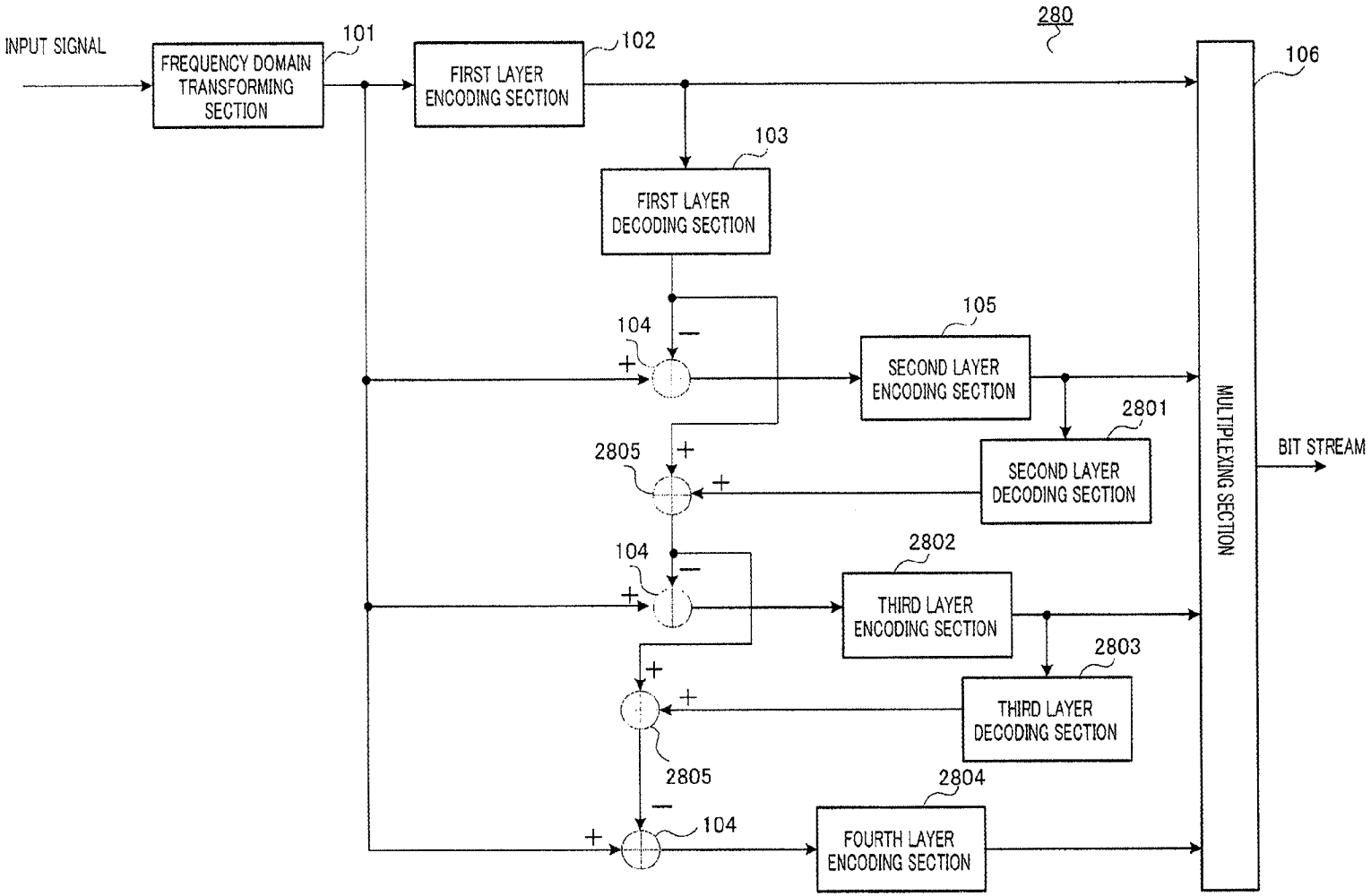
FIG. 28 is a block diagram showing another aspect of the main configuration of the encoding apparatus according to Embodiment 7.

Further, although a case has been explained with the present embodiment as an example where the number of layers in encoding apparatus 220 is two, the present invention is not limited to this, and encoding apparatus 220 may be configured to include two or more coding layers as in, for example, encoding apparatus 280 shown in FIG. 28.

FIG. 28 is a block diagram showing the main configuration of encoding apparatus 280. Compared to encoding apparatus 100 shown in FIG. 2, encoding apparatus 280 employs a configuration including three subtracting sections 104 with additions of second layer decoding section 2801, third layer encoding section 2802, third layer decoding section 2803, fourth layer encoding section 2804 and two adders 2805.

Third layer encoding section 2802 and fourth layer encoding section 2804 shown in FIG. 28 have the same configuration and perform the same operation as second layer encoding section 105 shown in FIG. 2, and second layer decoding section 2801 and third layer decoding section 2803 have the same configuration and perform the same operation as first layer decoding section 103 shown in FIG. 2. Here, the positions of bands in each layer encoding section will be explained using FIG. 29.

Figure 29A:
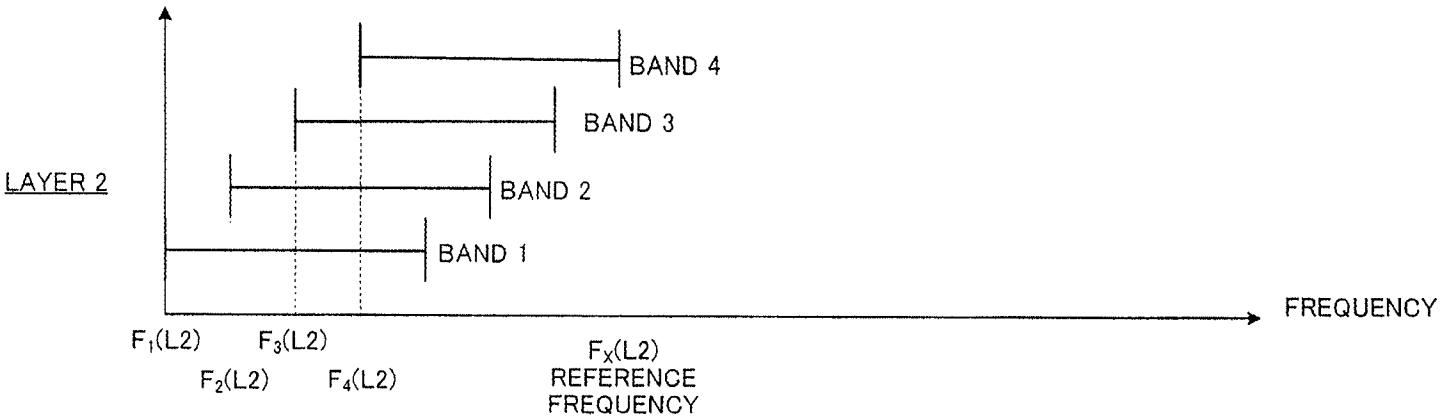
FIG. 29A shows the positions of bands in the second layer encoding section shown in FIG. 28.
Figure 29B:
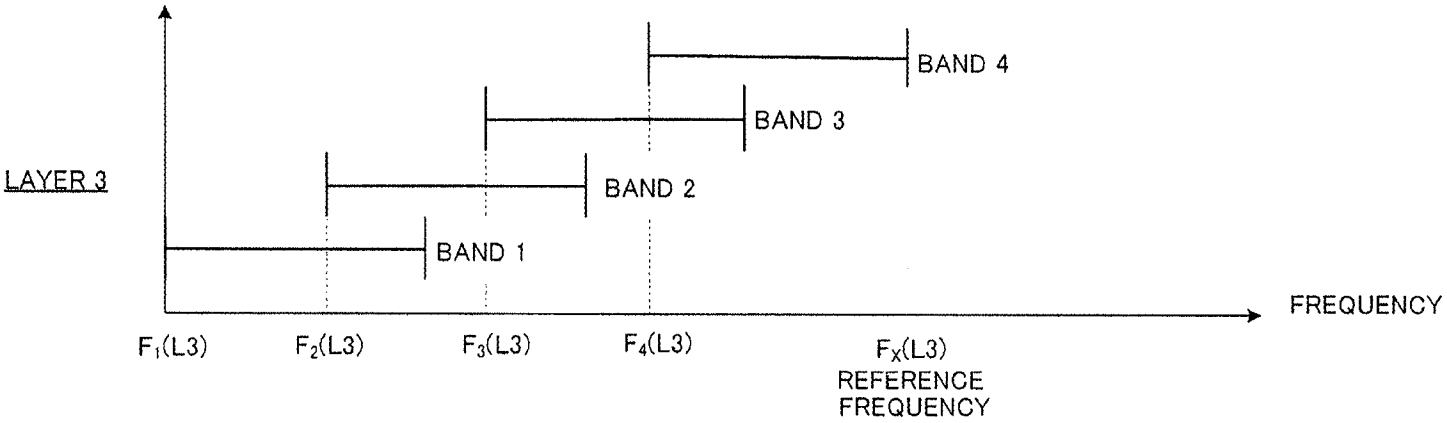
FIG. 29B shows the positions of bands in the third layer encoding section shown in FIG. 28.
Figure 29C:
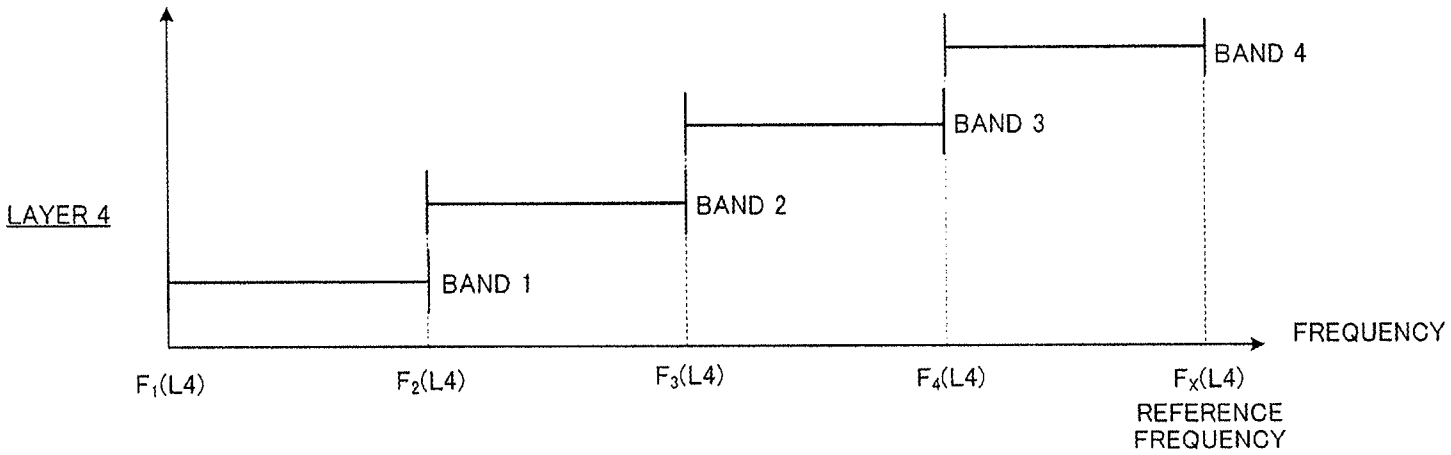
FIG. 29C shows the positions of bands in the fourth layer encoding section shown in FIG. 28.

As an example of band arrangement in each layer encoding section, FIG. 29A shows the positions of bands in the second layer encoding section, FIG. 29B shows the positions of bands in the third layer encoding section, and FIG. 29C shows the positions of bands in the fourth layer encoding section, and the number of bands is four in each figure.

To be more specific, four bands are arranged in second layer encoding section 105 such that the four bands do not exceed the reference frequency Fx(L2) of layer 2, four bands are arranged in third layer encoding section 2802 such that the four bands do not exceed the reference frequency Fx(L3) of layer 3 and bands are arranged in fourth layer encoding section 2804 such that the bands do not exceed the reference frequency Fx(L4) of layer 4. Moreover, there is the relationship of Fx(L2)<Fx(L3)<Fx(L4) between the reference frequencies of layers. That is, in layer 2 of a low bit rate, the band which is a target to be encoded is determined from the low frequency band of high perceptual sensitivity, and, in a higher layer of a higher bit rate, the band which is a target to be encoded is determined from a band including up to a high frequency band.

By employing such a configuration, a lower layer emphasizes a low frequency band and a high layer covers a wider band, so that it is possible to make high quality speech signals.

Figure 30:
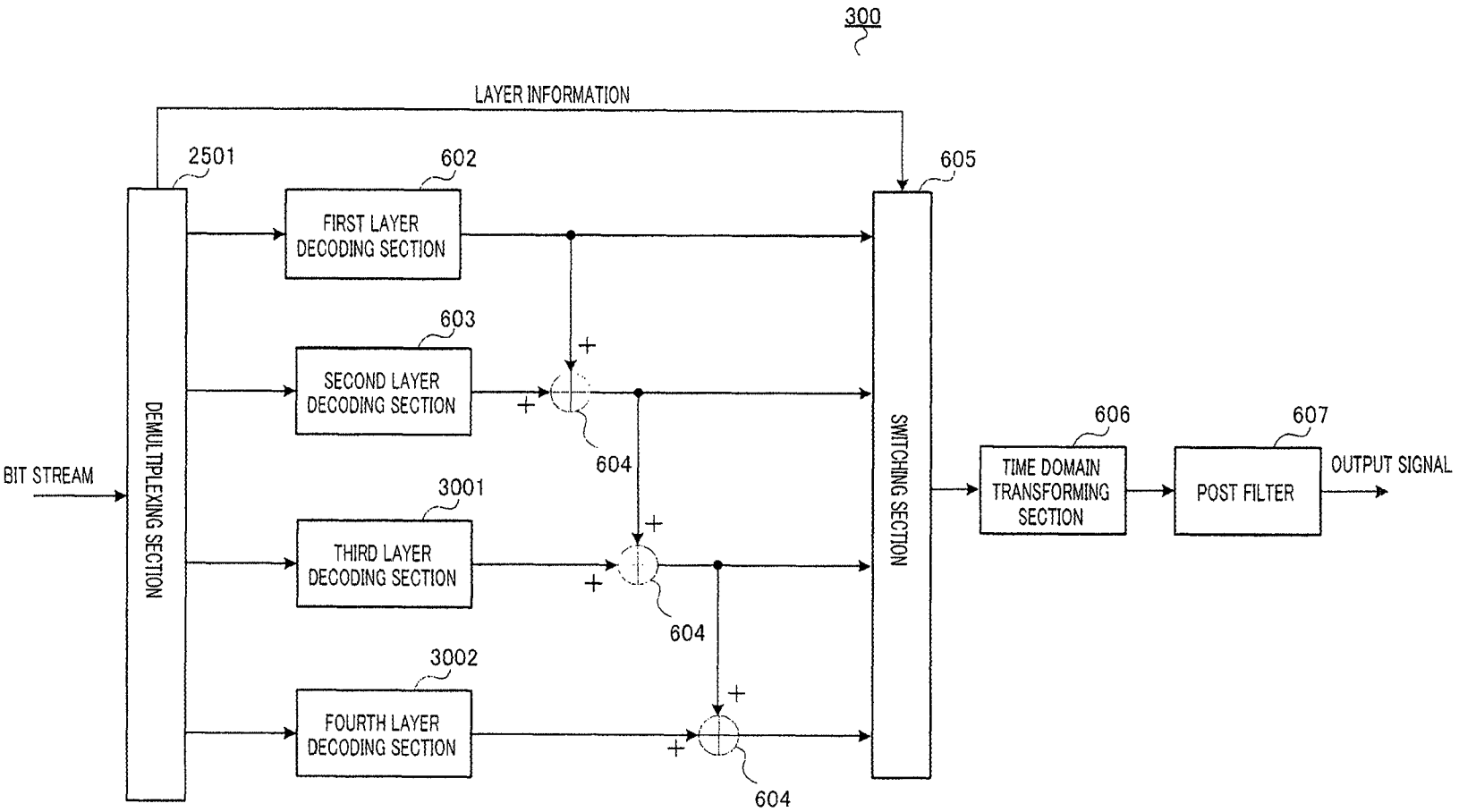
FIG. 30 is a block diagram showing the main configuration of the decoding apparatus supporting the encoding apparatus shown in FIG. 28.

FIG. 30 is a block diagram showing the main configuration of decoding apparatus 300 supporting encoding apparatus 280 shown in FIG. 28. Compared to decoding apparatus 600 shown in FIG. 8, decoding apparatus 300 in FIG. 30 employs a configuration with additions of third layer decoding section 3001, fourth layer decoding section 3002 and two adders 604. Further, third layer decoding section 3001 and fourth layer decoding section 3002 employ the same configuration and perform the same configuration as second layer decoding section 603 of decoding apparatus 600 shown in FIG. 8 and, therefore, detailed explanation thereof will be omitted.

Figure 31A:
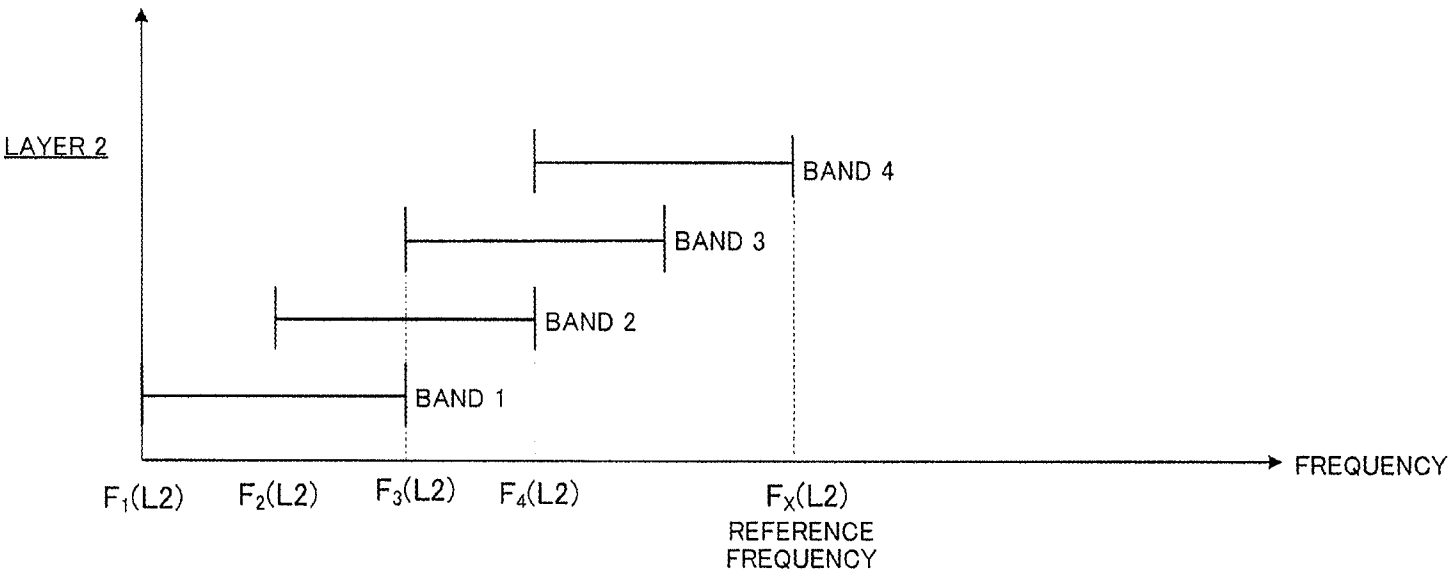
FIG. 31A shows other positions of bands in the second layer encoding section shown in FIG. 28.
Figure 31B:
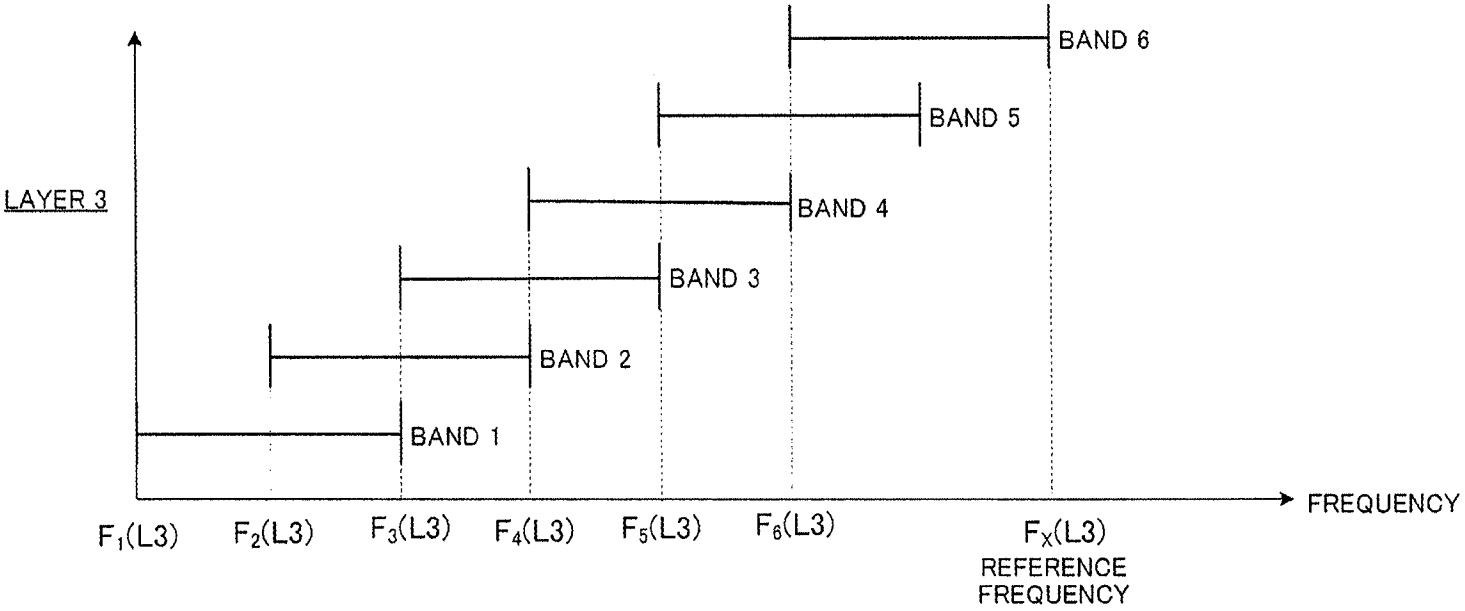
FIG. 31B shows other positions of bands in the third layer encoding section shown in FIG. 28.
Figure 31C:
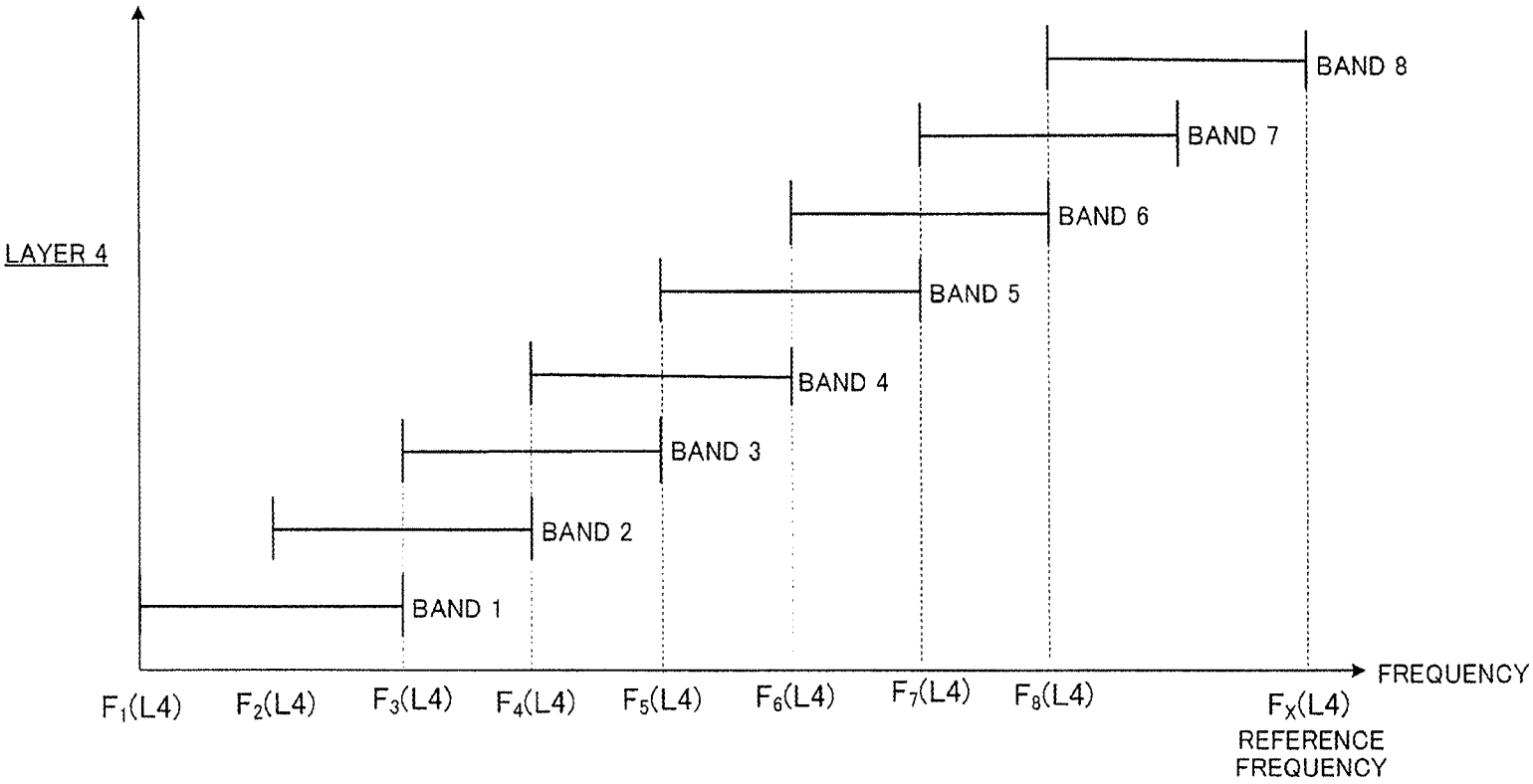
FIG. 31C shows other positions of bands in the fourth layer encoding section shown in FIG. 28.

As another example of band arrangement in each layer encoding section, FIG. 31A shows the positions of four bands in second layer encoding section 105, FIG. 31B shows the positions of six bands in third layer encoding section 2802 and FIG. 31C shows eight bands in fourth layer encoding section 2804.

In FIG. 31, bands are arranged at equal intervals in each layer encoding section, and only bands arranged in low frequency band are targets to be encoded by a lower layer shown in FIG. 31A and the number of bands which are targets to be encoded increases in a higher layer shown in FIG. 31B or FIG. 31C.

According to such a configuration, bands are arranged at equal intervals in each layer, and, when bands which are targets to be encoded are selected in a lower layer, few bands are arranged in a low frequency band as candidates to be selected, so that it is possible to reduce the computational complexity and bit rate.

Embodiment 8

Embodiment 8 of the present invention differs from Embodiment 1 only in the operation of the first position specifying section, and the first position specifying section according to the present embodiment will be assigned the reference numeral "801" to show this difference. To specify the band that can be employed by the target frequency as the target to be encoded, first position specifying section 801 divides in advance a full band into a plurality of partial bands and performs searches in each partial band based on predetermined bandwidths and predetermined step sizes. Then, first position specifying section 801 concatenates bands of each partial band that have been searched for and found out, to make a band that can be employed by the target frequency as the target to be encoded.

Figure 32:
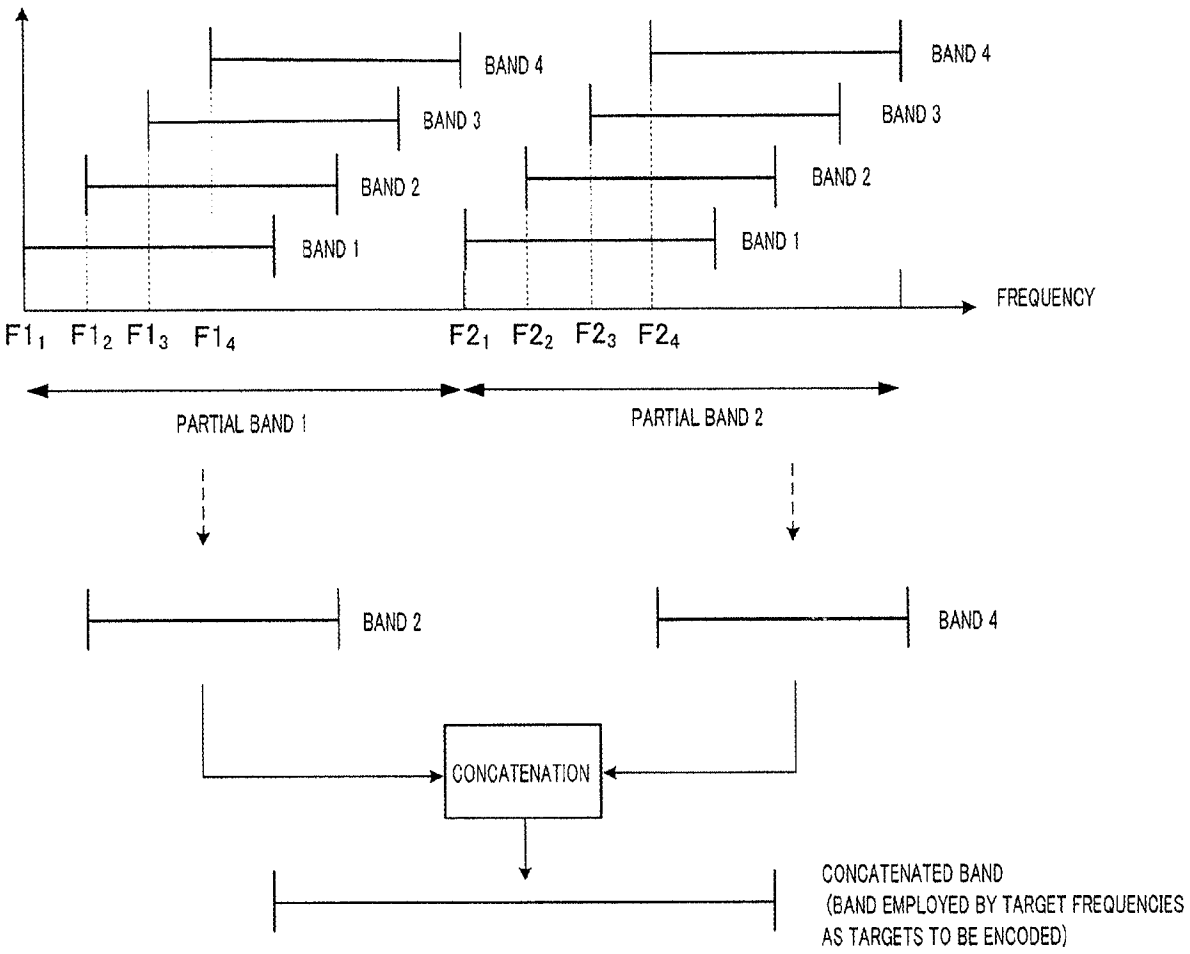
FIG. 32 illustrates the operation of the first position specifying section according to Embodiment 8.

The operation of first position specifying section 801 according to the present embodiment will be explained using FIG. 32. FIG. 32 illustrates a case where the number of partial bands is N=2, and partial band 1 is configured to cover the low frequency band and partial band 2 is configured to cover the high frequency band. One band is selected from a plurality of bands that are configured in advance to have a predetermined bandwidth (position information of this band is referred to as "first partial band position information") in partial band 1. Similarly, One band is selected from a plurality of bands configured in advance to have a predetermined bandwidth (position information of this band is referred to as "second partial band position information") in partial band 2.

Next, first position specifying section 801 concatenates the band selected in partial band 1 and the band selected in partial band 2 to form the concatenated band. This concatenated band is the band to be specified in first position specifying section 801 and, then, second position specifying section 202 specifies second position information based on the concatenated band. For example, in case where the band selected in partial band 1 is band 2 and the band selected in partial band 2 is band 4, first position specifying section 801 concatenates these two bands as shown in the lower part in FIG. 32 as the band that can be employed by the frequency band as the target to be encoded.

Figure 33:
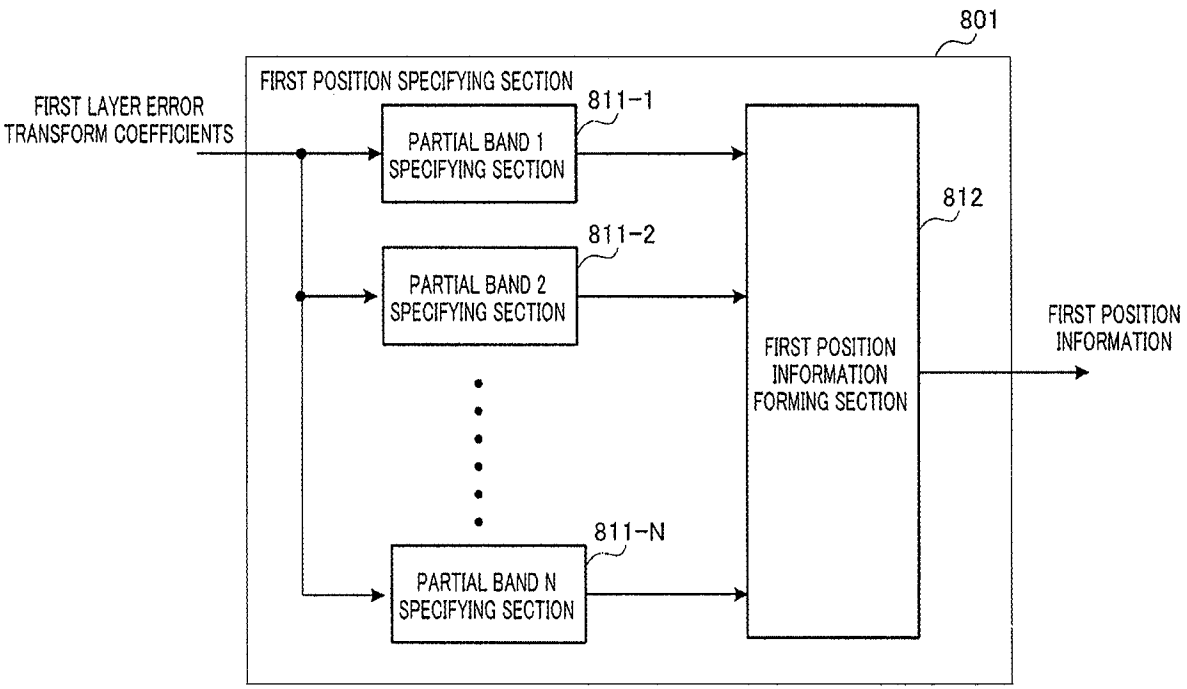
FIG. 33 is a block diagram showing the configuration of the first position specifying section according to Embodiment 8.

FIG. 33 is a block diagram showing the configuration of first position specifying section 801 supporting the case where the number of partial bands is N. In FIG. 33, the first layer error transform coefficients received from subtracting section 104 are given to partial band 1 specifying section 811-1 to partial band N specifying section 811-N. Each partial band n specifying section 811-*n* (where n=1 to N) selects one band from a predetermined partial band n, and outputs information showing the position of the selected band (i.e. n-th partial band position information) to first position information forming section 812.

First position information forming section 812 forms first position information using the n-th partial band position information (where n=1 to N) received from each partial band n specifying section 811-*n*, and outputs this first position information to second position specifying section 202, encoding section 203 and multiplexing section 204.

Figure 34:
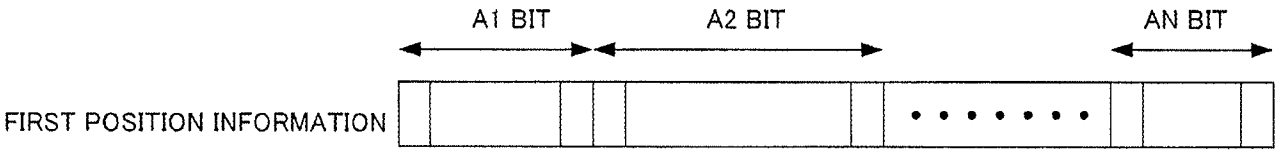
FIG. 34 illustrates how the first position information is formed in the first position information forming section according to Embodiment 8.

FIG. 34 illustrates how the first position information is formed in first position information forming section 812. In this figure, first position information forming section 812 forms the first position information by arranging first partial band position information (i.e. A1 bit) to the N-th partial band position information (i.e. AN bit) in order. Here, the bit length An of each n-th partial band position information is determined based on the number of candidate bands included in each partial band n, and may have a different value.

Figure 35:
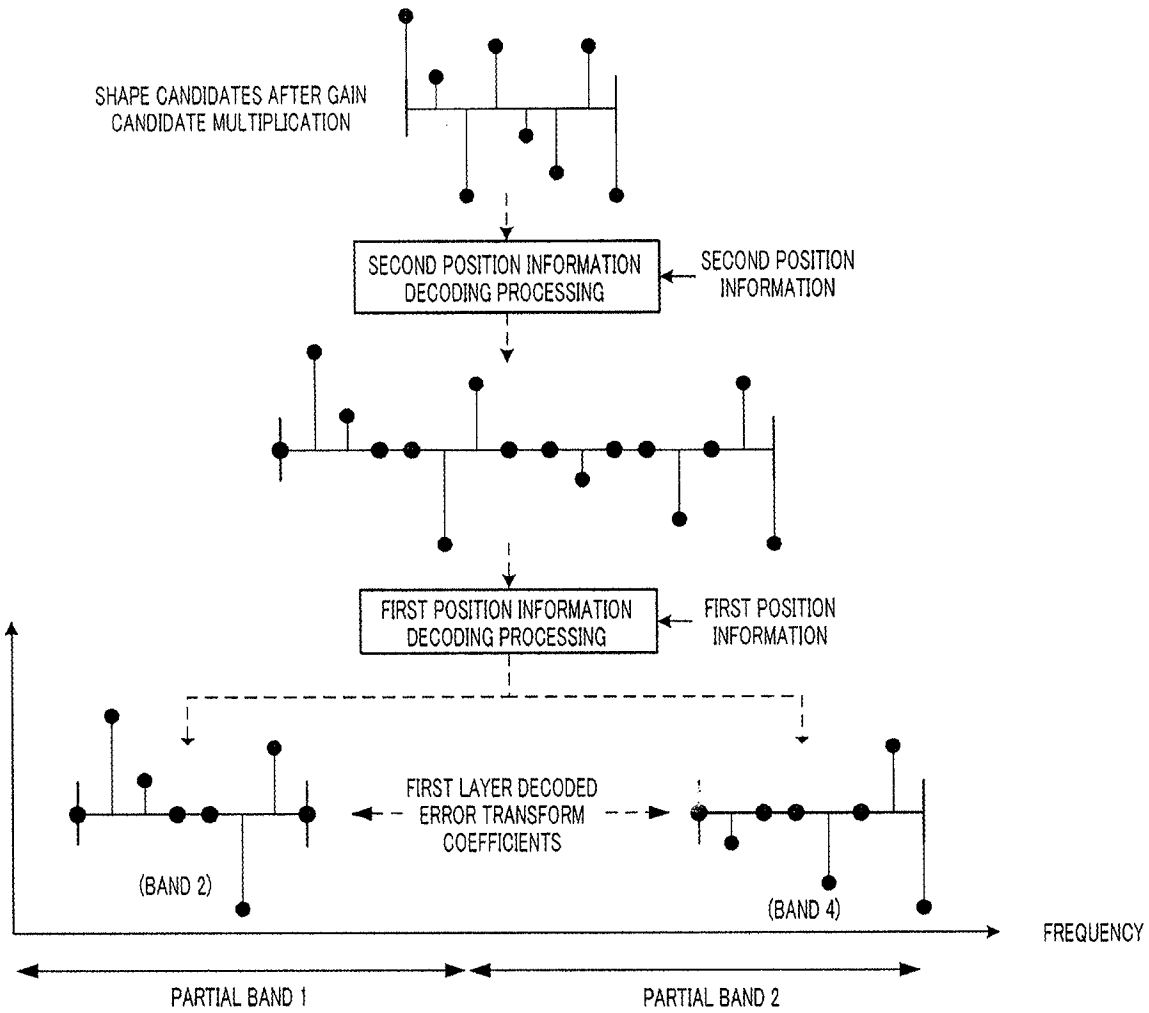
FIG. 35 illustrates decoding processing according to Embodiment 8.

FIG. 35 shows how the first layer decoded error transform coefficients are found using the first position information and second position information in decoding processing of the present embodiment. Here, a case will be explained as an example where the number of partial bands is two. Meanwhile, in the following explanation, names and numbers of each component forming second layer decoding section 603 according to Embodiment 1 will be appropriated.

Arranging section 704 rearranges shape candidates after gain candidate multiplication received from multiplying section 703, using the second position information. Next, arranging section 704 rearranges the shape candidates after the rearrangement using the second position information, in partial band 1 and partial band 2 using the first position information. Arranging section 704 outputs the signal found in this way as first layer decoded error transform coefficients.

According to the present embodiment, the first position specifying section selects one band from each partial band and, consequently, makes it possible to arrange at least one decoded spectrum in each partial band. By this means, compared to the embodiments where one band is determined from a full band, a plurality of bands for which sound quality needs to be improved can be set in advance. The present embodiment is effective, for example, when quality of both the low frequency band and high frequency band needs to be improved.

Further, according to the present embodiment, even when encoding is performed at a low bit rate in a lower layer (i.e. the first layer with the present embodiment), it is possible to improve the subjective quality of the decoded signal. The configuration applying the CELP scheme to a lower layer is one of those examples. The CELP scheme is a coding scheme based on waveform matching and so performs encoding such that the quantization distortion in a low frequency band of great energy is minimized compared to a high frequency band. As a result, the spectrum of the high frequency band is attenuated and is perceived as muffled (i.e. missing of feeling of the band). By contrast with this, encoding based on the CELP scheme is a coding scheme of a low bit rate, and therefore the quantization distortion in a low frequency band cannot be suppressed much and this quantization distortion is perceived as noisy. The present embodiment selects bands as the targets to be encoded, from a low frequency band and high frequency band, respectively, so that it is possible to cancel two different deterioration factors of noise in the low frequency band and muffled sound in the high frequency band, at the same time, and improve subjective quality.

Further, the present embodiment forms a concatenated band by concatenating a band selected from a low frequency band and a band selected from a high frequency band and determines the spectral shape in this concatenated band, and, consequently, can perform adaptive processing of selecting the spectral shape emphasizing the low frequency band in a frame for which quality improvement is more necessary in a low frequency band than in a high frequency band and selecting the spectral shape emphasizing the high frequency band in a frame for which quality improvement is more necessary in the high frequency band than in the low frequency band, so that it is possible to improve subjective quality. For example, to represent the spectral shape by pulses, more pulses are allocated in a low frequency band in a frame for which quality improvement is more necessary in the low frequency band than in the high frequency band, and more pulses are allocated in the high frequency band in a frame for which quality improvement is more necessary in the high frequency band than in the low frequency band, so that it is possible to improve subjective quality by means of such adaptive processing.

Figure 36:
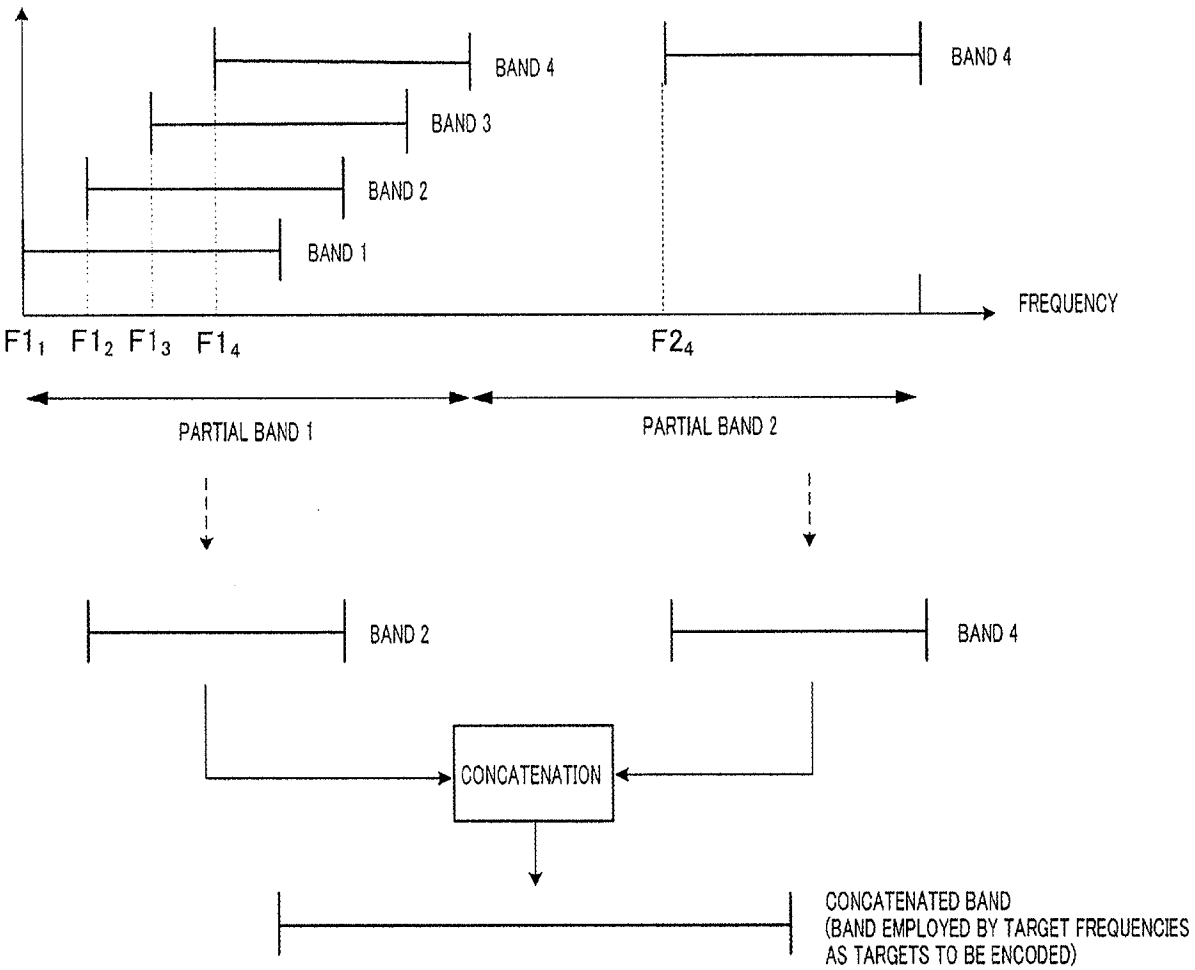
FIG. 36 illustrates a variation of Embodiment 8.

Further, as a variation of the present embodiment, a fixed band may be selected at all times in a specific partial band as shown in FIG. 36. With the example shown in FIG. 36, band 4 is selected at all times in partial band 2 and forms part of the concatenated band. By this means, similar to the advantage of the present embodiment, the band for which sound quality needs to be improved can be set in advance, and, for example, partial band position information of partial band 2 is not required, so that it is possible to reduce the number of bits for representing the first position information shown in FIG. 34.

Further, although FIG. 36 shows a case as an example where a fixed region is selected at all times in the high frequency band (i.e. partial band 2), the present invention is not limited to this, and a fixed region may be selected at all times in the low frequency band (i.e. partial band 1) or the fixed region may be selected at all times in the partial band of a middle frequency band that is not shown in FIG. 36.

Figure 37:
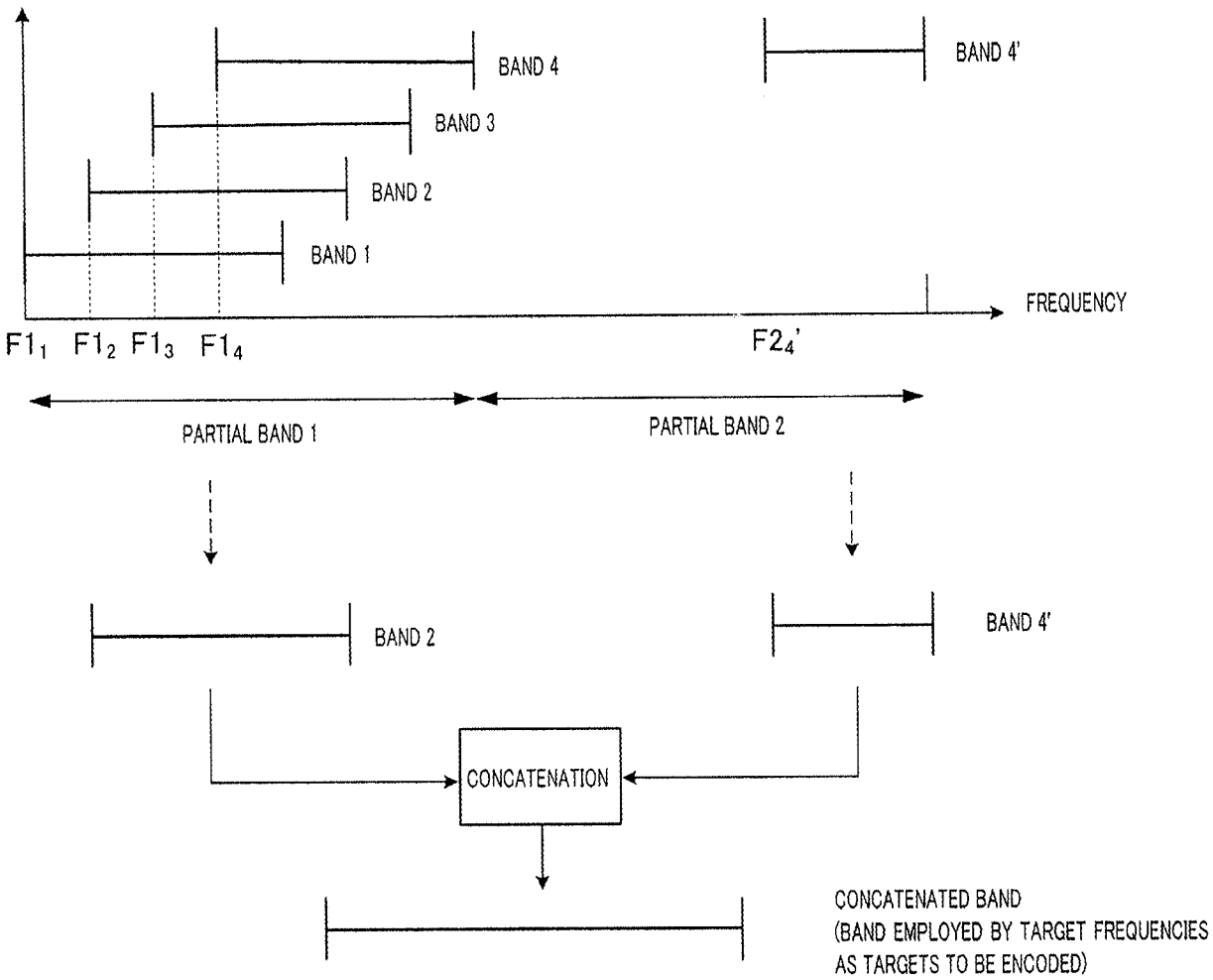
FIG. 37 illustrates a variation of Embodiment 8.

Further, as a variation of the present embodiment, the bandwidth of candidate bands set in each partial band may vary as show in FIG. 37. FIG. 37 illustrates a case where the bandwidth of the partial band set in partial band 2 is shorter than candidate bands set in partial band 1.

Embodiments of the present invention have been explained.

Further, band arrangement in each layer encoding section is not limited to the examples explained above with the present invention, and, for example, a configuration is possible where the bandwidth of each band is made narrower in a lower layer and the bandwidth of each band is made wider in a higher layer.

Further, with the above embodiments, the band of the current frame may be selected in association with bands selected in past frames. For example, the band of the current frame may be determined from bands positioned in the vicinities of bands selected in previous frames. Further, by rearranging band candidates for the current frame in the vicinities of the bands selected in the previous frames, the band of the current frame may be determined from the rearranged band candidates. Further, by transmitting region information once every several frames, a region shown by the region information transmitted in the past may be used in a frame in which region information is not transmitted (discontinuous transmission of band information).

Furthermore, with the above embodiments, the band of the current layer may be selected in association with the band selected in a lower layer. For example, the band of the current layer may be selected from the bands positioned in the vicinities of the bands selected in a lower layer. By rearranging band candidates of the current layer in the vicinities of bands selected in a lower layer, the band of the current layer may be determined from the rearranged band candidates. Further, by transmitting region information once every several frames, a region indicated by the region information transmitted in the past may be used in a frame in which region information is not transmitted (intermittent transmission of band information).

Furthermore, the number of layers in scalable coding is not limited with the present invention.

Still further, although the above embodiments assume speech signals as decoded signals, the present invention is not limited to this and decoded signals may be, for example, audio signals.

Also, although cases have been described with the above embodiment as examples where the present invention is configured by hardware, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2007-053498, filed on Mar. 2, 2007, Japanese Patent Application No. 2007-133525, filed on May 18, 2007, Japanese Patent Application No. 2007-184546, filed on Jul. 13, 2007, and Japanese Patent Application No. 2008-044774, filed on Feb. 26, 2008, including the specifications, drawings and abstracts, are incorporated herein by reference in its entirety.

INDUSTRIAL APPLICABILITY

The present invention is suitable for use in an encoding apparatus, decoding apparatus and so on used in a communication system of a scalable coding scheme.

What is claimed is:

1. A speech encoding apparatus, comprising:

a first layer encoder that performs encoding processing, using a processor, with respect to an input speech signal to generate first layer encoded data;

a first layer decoder that performs decoding processing, using the processor, using the first layer encoded data to generate a first layer decoded signal;

a first layer error transform coefficient calculator that transforms, using the processor, a first layer error signal which is an error between the input speech signal and the first layer decoded signal into a frequency domain to calculate first layer error transform coefficients; and a second layer encoder that performs encoding processing, using the processor, with respect to the first layer error transform coefficients to generate second layer encoded data, wherein the second layer encoder:

selects a first band from among a plurality of band candidates, which have a predetermined bandwidth and are arranged based on a first step size narrower than the predetermined bandwidth, based on a magnitude of energy of the first layer error transform coefficients in the plurality of band candidates, and generates first position information showing a position of the selected first band;

specifies positions of a plurality of pulses from among pulse candidate positions, which are set based on a second step size narrower than the first step size in the selected first band, and generates second position information showing the specified positions of the plurality of pulses; and generates the second layer encoded data using the first position information and the second position information.

2. The speech encoding apparatus according to claim 1, wherein the second layer encoder specifies a position of a pulse based on the magnitude of energy of the first layer error transform coefficients.

3. The speech encoding apparatus according to claim 1, wherein the second layer encoder generates gain information showing an amplitude of a pulse at a pulse position based on the first layer error transform coefficients, and the second layer encoder generates the second layer encoded data further using the gain information.

4. The speech encoding apparatus according to claim 1, wherein the second layer encoder selects the first band from a low-frequency portion lower than a predetermined reference frequency.

5. A speech decoding apparatus, comprising:

a receiver that receives, using a processor:

first layer encoded data acquired in a speech encoder by performing encoding processing with respect to an input speech signal; and second layer encoded data acquired in the speech encoder by transforming a first layer error signal which is an error between a first layer decoded signal obtained by decoding the first layer encoded data and the input speech signal into a frequency domain to calculate first layer error transform coefficients and by performing encoding processing with respect to the first layer error transform coefficients;

a first layer decoder that decodes, using the processor, the first layer encoded data to generate the first layer decoded signal;

a second layer decoder that decodes, using the processor, the second layer encoded data to generate first layer decoded error transform coefficients;

a time domain transformer that transforms, using the processor, the first layer decoded error transform coefficients into a time domain to generate a first layer decoded error signal; and an adder that adds the first layer decoded signal and the first layer decoded error signal to generate a decoded signal, wherein the second layer decoder:

decodes the second layer encoded data to generate first position information showing a position of a first band having a predetermined bandwidth and second position information showing positions of a plurality of pulses in the first band; and specifies the positions of the plurality of pulses using the first position information and the second position information to generate the first layer decoded error transform coefficients.

6. The speech decoding apparatus according to claim 5, wherein the second layer decoder decodes the second layer encoded data to generate gain information showing an amplitude of a pulse, and generates the first layer decoded error transform coefficients further using the gain information.

7. A speech encoding method, comprising:

performing encoding processing, by a processor, with respect to an input speech signal to generate first layer encoded data;

performing decoding processing, by the processor, using the first layer encoded data to generate a first layer decoded signal;

transforming, by the processor, a first layer error signal which is an error between the input speech signal and the first layer decoded signal into a frequency domain to calculate first layer error transform coefficients; and performing encoding processing, by the processor, with respect to the first layer error transform coefficients to generate second layer encoded data, wherein the encoding processing with respect to the first layer error transform coefficients comprises:

selecting a first band from among a plurality of band candidates, which have a predetermined bandwidth and are arranged based on a first step size narrower than the predetermined bandwidth, based on a magnitude of energy of the first layer error transform coefficients in the plurality of band candidates, and generating first position information showing a position of the selected first band;

specifying positions of a plurality of pulses from among pulse candidate positions, which are set based on a second step size narrower than the first step size in the selected first band, and generating second position information showing the specified positions of the plurality of pulses; and generating the second layer encoded data using the first position information and the second position information.

8. A speech decoding method, comprising:

receiving, by a processor:

first layer encoded data acquired using a speech encoding method by performing encoding processing with respect to an input speech signal; and second layer encoded data acquired using the speech encoding method by transforming a first layer error signal which is an error between a first layer decoded signal obtained by decoding the first layer encoded data and the input speech signal into a frequency domain to calculate first layer error transform coefficients and by performing encoding processing with respect to the first layer error transform coefficients;

decoding, by the processor, the first layer encoded data to generate the first layer decoded signal;

decoding, by the processor, the second layer encoded data to generate first layer decoded error transform coefficients;

transforming, by the processor, the first layer decoded error transform coefficients into a time domain to generate a first layer decoded error signal; and adding, by the processor, the first layer decoded signal and the first layer decoded error signal to generate a decoded signal, wherein in the decoding of the second layer encoded data:

the second layer encoded data is decoded to generate first position information showing a position of a first band having a predetermined bandwidth and second position information showing positions of a plurality of pulses in the first band; and the positions of the plurality of pulses are specified using the first position information and the second position information to generate the first layer decoded error transform coefficients.

* * * * *